US006328601B1

(12) United States Patent
Yip et al.

(10) Patent No.: US 6,328,601 B1
(45) Date of Patent: Dec. 11, 2001

(54) ENHANCED PERFORMANCE TELECOMMUNICATIONS CONNECTOR

(75) Inventors: Maxwell Yip, Trumbull; Denny Lo, Danbury; Randy Below, Cheshire; John A. Siemon, Woodbury, all of CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 09/007,313

(22) Filed: Jan. 15, 1998

(51) Int. Cl.[7] ..... H01R 13/648
(52) U.S. Cl. ..... 439/608; 439/610
(58) Field of Search ..... 439/607–619, 439/95–110, 409–412, 446

(56) References Cited

U.S. PATENT DOCUMENTS

| | | | |
|---|---|---|---|
| 4,337,989 | | 7/1982 | Asick et al. . |
| 4,659,163 | | 4/1987 | Althouse et al. . |
| 4,682,836 | | 7/1987 | Noorily et al. . |
| 4,990,094 | | 2/1991 | Chandler et al. . |
| 5,372,513 | | 12/1994 | Rodrigues et al. . |
| 5,376,021 | | 12/1994 | Rodrigues et al. . |
| 5,509,824 | | 4/1996 | Rodrigues et al. . |
| 5,538,440 | | 7/1996 | Rodrigues et al. . |
| 5,564,940 | | 10/1996 | Rodriques et al. . |
| 5,564,949 | | 10/1996 | Wellinsky . |
| 5,593,311 | | 1/1997 | Lybrand . |
| 5,605,469 | * | 2/1997 | Wellinsky et al. ..... 439/417 |
| 5,660,551 | * | 8/1997 | Sakurai et al. ..... 439/108 |
| 5,681,180 | | 10/1997 | Rodrigues . |
| 5,876,248 | * | 3/1999 | Brunker et al. ..... 439/608 |
| 5,890,917 | * | 4/1999 | Ishida et al. ..... 439/101 |
| 5,895,292 | | 4/1999 | Affeltranger . |
| 6,045,389 | | 4/2000 | Ferrill et al. ..... 439/398 |
| 6,077,122 | | 6/2000 | Elkhatib et al. ..... 439/608 |

FOREIGN PATENT DOCUMENTS

| | | |
|---|---|---|
| 0 268 441 A2 | 5/1988 | (EP) . |
| 0 517 180 A1 | 12/1992 | (EP) . |
| 0 755 100 A2 | 1/1997 | (EP) . |
| 250597 | of 1995 | (TW) . |
| WO87/07441 | 12/1987 | (WO) . |
| WO89/11169 | 11/1989 | (WO) . |
| WO92/08261 | 5/1992 | (WO) . |
| WO92/09119 | 5/1992 | (WO) . |

OTHER PUBLICATIONS

WO 98/48488 PCT Oct. 29, 1998.

* cited by examiner

*Primary Examiner*—Lincoln Donovan
(74) *Attorney, Agent, or Firm*—Cantor Colburn LLP

(57) ABSTRACT

A connector made up of a plug and outlet which, when mated, define four shielded quadrants, each of which houses a pair of contacts. Shield members within the plug overlap and shield members within the outlet overlap. In addition, shield members within the outlet overlap adjacent shield members in the plug when mated. Overlapping the shield members at each shield member junction provides enhanced shielding and reduced crosstalk.

8 Claims, 30 Drawing Sheets

ENHANCED PERFORMANCE TELECOMMUNICATIONS CONNECTOR

BACKGROUND OF THE INVENTION

1. Field of the Invention

The invention relates generally to telecommunications connectors and in particular to a telecommunications plug and outlet having enhanced performance characteristics.

2. Prior Art

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ. To achieve such transmission rates, fully shielded twisted pair cable will be necessary in which each pair is individually wrapped in a foil or screen. In addition, all pairs are wrapped together in a layer of foil or screen.

The above referenced transmission requirements also specify limits on near-end crosstalk (NEXT). Telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

U.S. Pat. No. 5,593,311 discloses a shielded compact data connector designed to reduce crosstalk between contacts of the connector. Pairs of contacts are placed within metallic channels. When the connectors are mated, the channels abut against each other to enclose each pair in a metallic shield. One disadvantage to the design in U.S. Pat. No. 5,593,311 is that the metallic channels are joined at a butt joint; one surface abuts against the adjacent surface with no overlap. Since all components include some manufacturing tolerance, there is a potential for gaps between the shields thereby reducing the shielding effect. Another disadvantage is that wires having the foil removed can be exposed to each other at the rear of the connector thus leading to crosstalk. Thus, there is a perceived need in the art for a connector having improved pair shielding.

SUMMARY OF THE INVENTION

The above-discussed and other drawbacks and deficiencies of the prior art are overcome or alleviated by the enhanced performance telecommunications connector of the present invention. The connector is made up of a plug and outlet which, when mated, define four shielded quadrants, each of which houses a pair of contacts. Shield members within the plug overlap and shield members within the outlet overlap. In addition, shield members within the outlet overlap adjacent shield members on the plug when mated. Overlapping the shield members at each shield member juncture provides enhanced shielding and reduced crosstalk.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
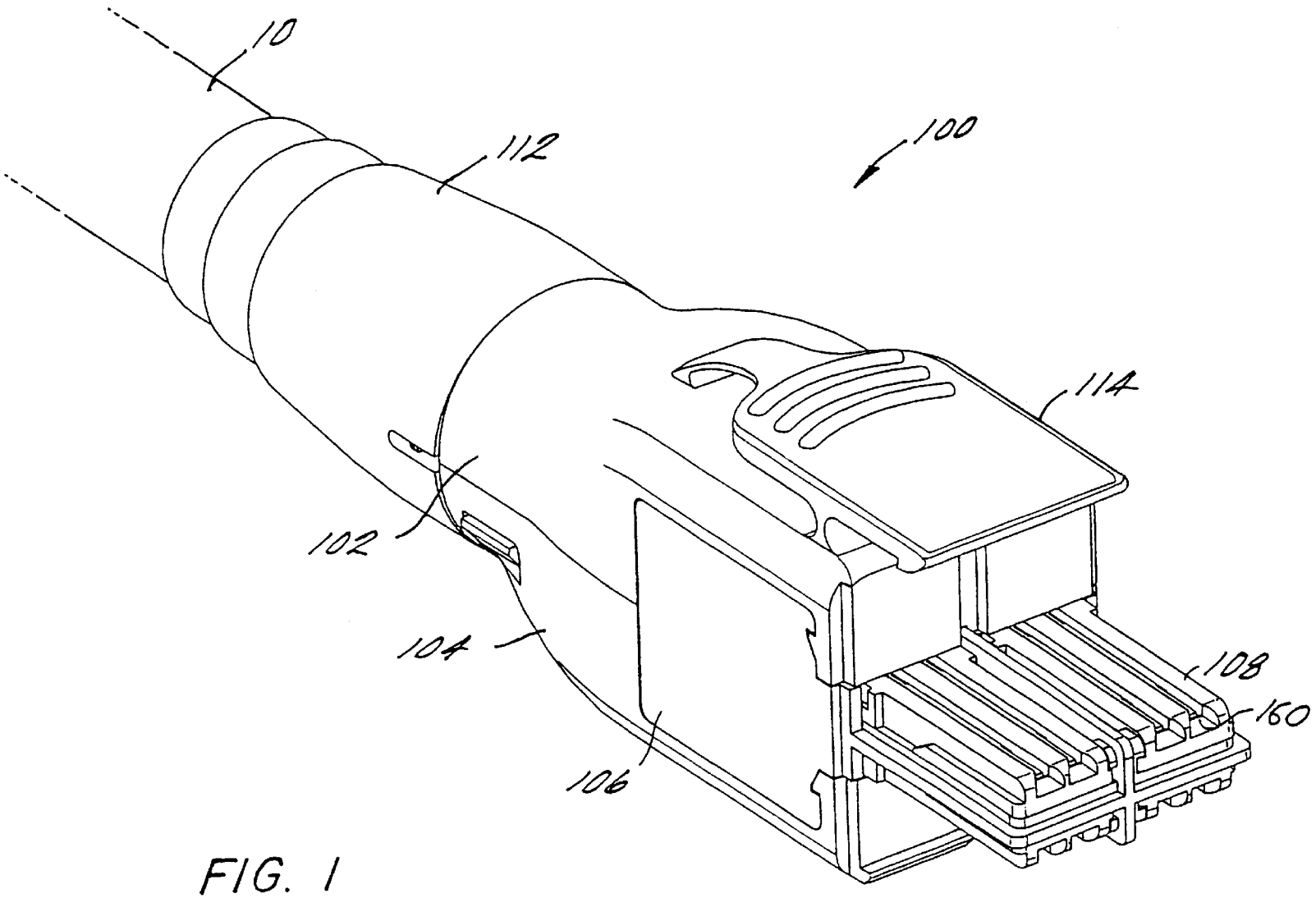
FIG. 1 is a perspective view of an assembled plug in accordance with the present invention.

FIG. 1 is a perspective view of an assembled plug, shown generally as 100, in accordance with the present invention. The plug 100 includes a top cover 102, a bottom cover 104 and a core 106. The top cover 102, bottom cover 104 and core 106 are all conductive to provide shielding as described herein. These conductive components may be made from metal, metallized plastic or any other known conductive material. Core 106 supports insulative (e.g. plastic) contact carriers 108. Each contact carrier 108 includes two contacts 110 defining a pair. A boot 112 provides strain relief and is made from a pliable plastic or rubber. Also shown in FIG. 1 is cable 10 entering boot 112. A latch 114 is provided on the top cover 102 for coupling the plug 100 to outlet 300 as described herein.

Figure 2:
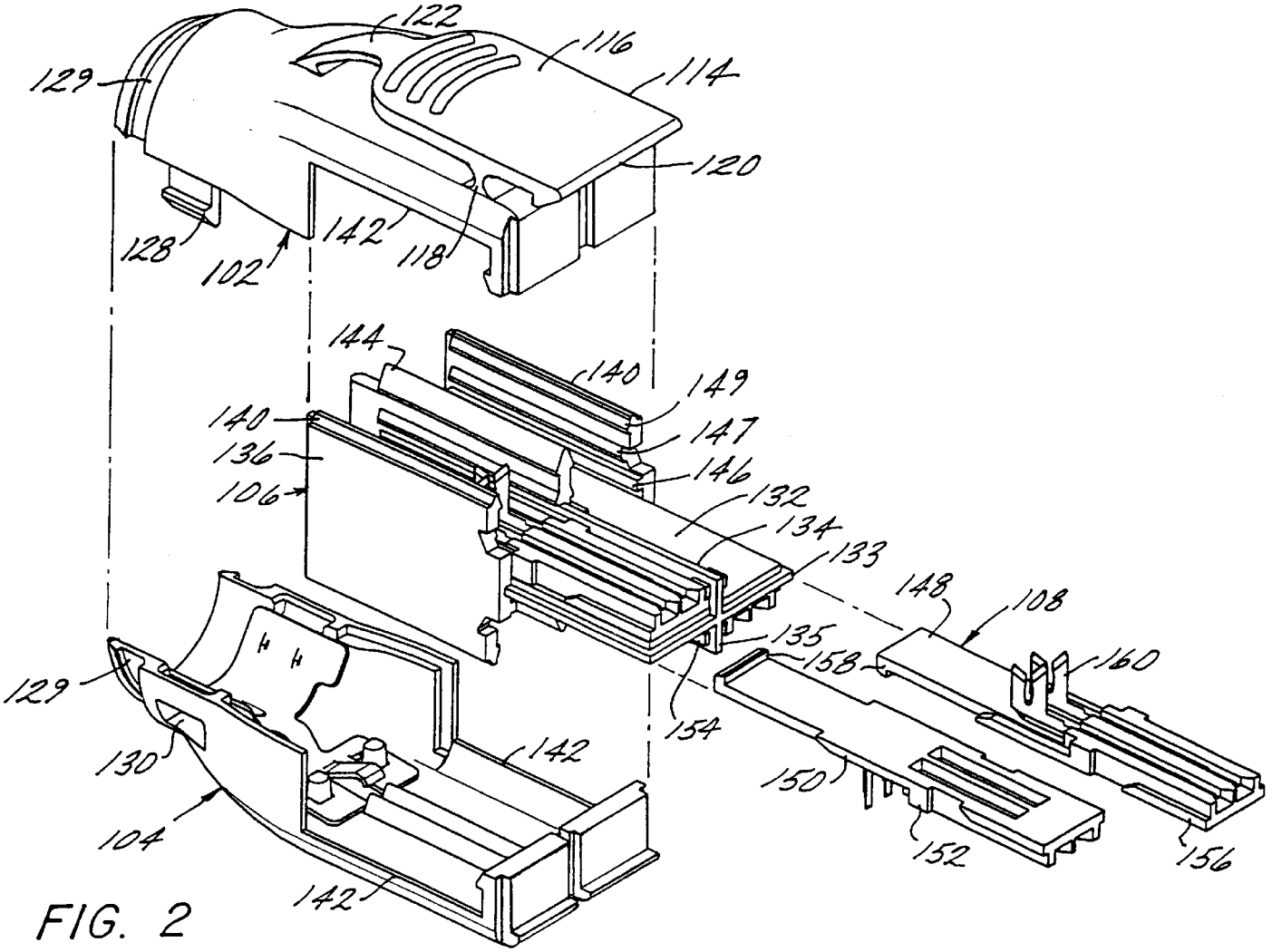
FIG. 2 is an exploded, perspective view of the plug.

FIG. 2 is an exploded, perspective view of the plug 100. Latch 114 is made up of a latch body 116 secured to the top cover at fulcrum 118. A lip 120 is provided on the bottom of the latch body 116 for engaging a groove formed in outlet 300. This secures the plug 100 to the outlet 300. An important feature of latch 114 is a latch extension 122 that couples the latch body 116 to the top cover 102. The latch extension 122 is a pliable, arcuate member that flexes when pressure is applied to latch body 116. Telecommunications plugs are often pulled through wall spaces during installation. The latch extension 122 reduces the likelihood that the plug 100 will be caught on other cables, wall corners, studs, etc. Top cover 102 includes a semi-circular groove 129 and bottom cover 104 includes a similar semi-circular groove 129 that receive a circular lip 113 (FIG. 7) in boot 112 as described below. Two top cover latches 128 engage two bottom cover recesses 130 to secure top cover 102 to bottom cover 104.

Plug core 106 includes a first planar shield 132 and a second planar shield 134 substantially perpendicular to the first planar shield 132. Plug core 106 also includes side walls 136. The top and bottom of each side wall 136 include a ridge 140. Ridges 140 extend beyond side wall 136 and overlap an edge 142 of the top cover 102 and bottom cover 104. Ridges 140 are shown as having a generally triangular cross section, but it is understood that different geometries may be used without departing from the scope of the invention. Ridges 140 serve to locate the core 106 within the top and bottom covers and overlap the edges of the top cover and bottom cover to provide better shielding than a butt joint. The second planar shield 134 also includes a ridge 144 on the top and bottom surfaces. As shown in FIG. 2 central ridge 144 is triangular, however, it is understood that other geometries may be used without departing from the invention. Central ridge 144 engages channels 178 formed in top cover 102 and bottom cover 104 as described below with reference to FIGS. 3 and 4.

Two ribs 146 are formed on the inside surface of each side wall 136 and are parallel to and spaced apart from first planar shield 132. Similar ribs are formed on each surface of the second planar shield 134. Contact carrier 108 has a planar base 148 which rests on the first planar shield 132. Base 148 includes two flanges 150 extending away from the base and a stop 152 adjacent to the flanges 150. When the contact carrier is installed in the core 106, flange 150 is placed under rib 146 to hold the contact carrier 108 to the first planar shield 132. The contact carrier is slid into core 106 until stop 152 contacts the end of rib 146. In this position, a second flange 156 is positioned beneath a nub 154 formed on the second planar shield 134. The contact carrier 108 also includes a lip 158 that extends substantially perpendicular to the planar base 148 and beyond the edge of first planar shield 132 to prevent the contact carrier 108 from sliding out of the core 106. Additional detail of the contact carrier 108 and contacts 160 are described below with reference to FIG. 5. The inside of each side wall 136 and each side of second planar shield 134 also include a first ledge 149 and a second ledge 147 which are used to secure a termination cap to the plug core 106 as described below with reference to FIGS. 6–10.

Figure 3:
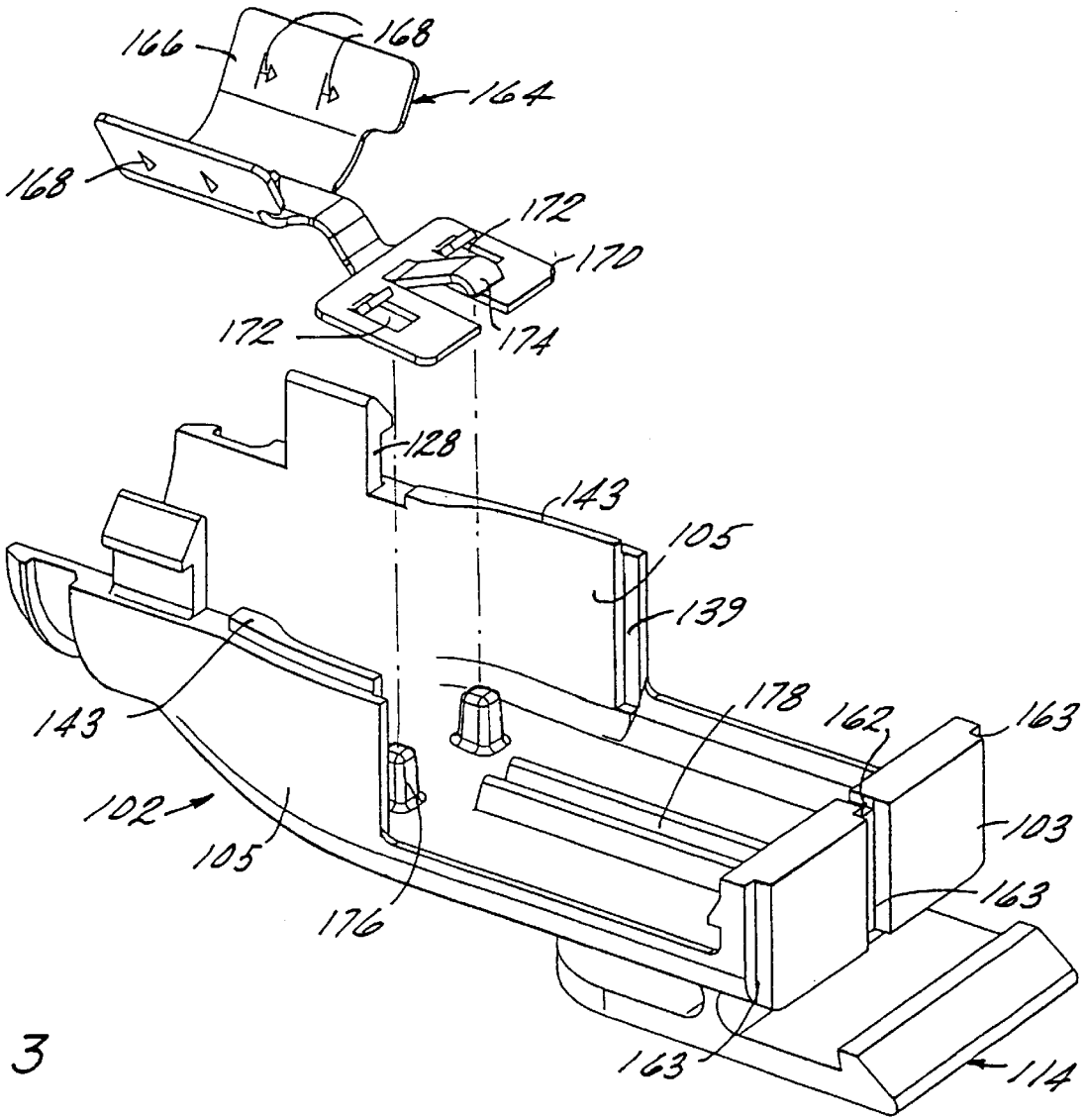
FIG. 3 is an exploded, perspective view of the plug top cover.

FIG. 3 is an exploded, perspective view of the top cover 102. The top cover includes a shield contact 164 which electrically connects the ground layer of cable 10 to the plug core 106. Shield contact 164 is conductive and is preferably made from metal. Shield contact 164 has an arcuate portion 166 formed to generally follow the shape of cable 10. Arcuate portion 166 includes barbs 168 that pierce the ground layer of cable 10 and the cable jacket. This electrically and mechanically connects the shield contact 164 to cable 10. Shield contact 164 includes a pad 170 having two openings 172 formed therein for receiving two posts 176 formed in top cover 102. The friction fit between posts 176 and openings 172 secures the shield contact 164 to top cover 102. A tab 174 extends away from pad 170 and contacts the plug core 106. A channel 178 is formed in the top cover 102 for receiving central ridge 144 on plug core 106. This allows the central ridge 144 to be overlapped by the side walls of the channel 178 and provides better shielding than a conventional butt joint. A notch 162 is provided in the front face 103 of top cover 102 to receive the second planar shield 134. The front face 103 of plug 102 also includes three recessed areas 163 that receive extensions on the front face 317 of outlet 300 as described below. Top cover 102 includes side wall recesses 139 for receiving rear extensions 137 on plug core 106 (FIG. 6) to create an overlap between the rear of plug core side wall 328 and the plug top cover. Top cover 102 also includes side walls 105 having a top side wall extensions 143 that engage outlet side wall recesses 343 (FIG. 4) to create overlap between the side walls 105 of the top plug cover 102 and the side walls 107 bottom plug cover 104.

Figure 4:
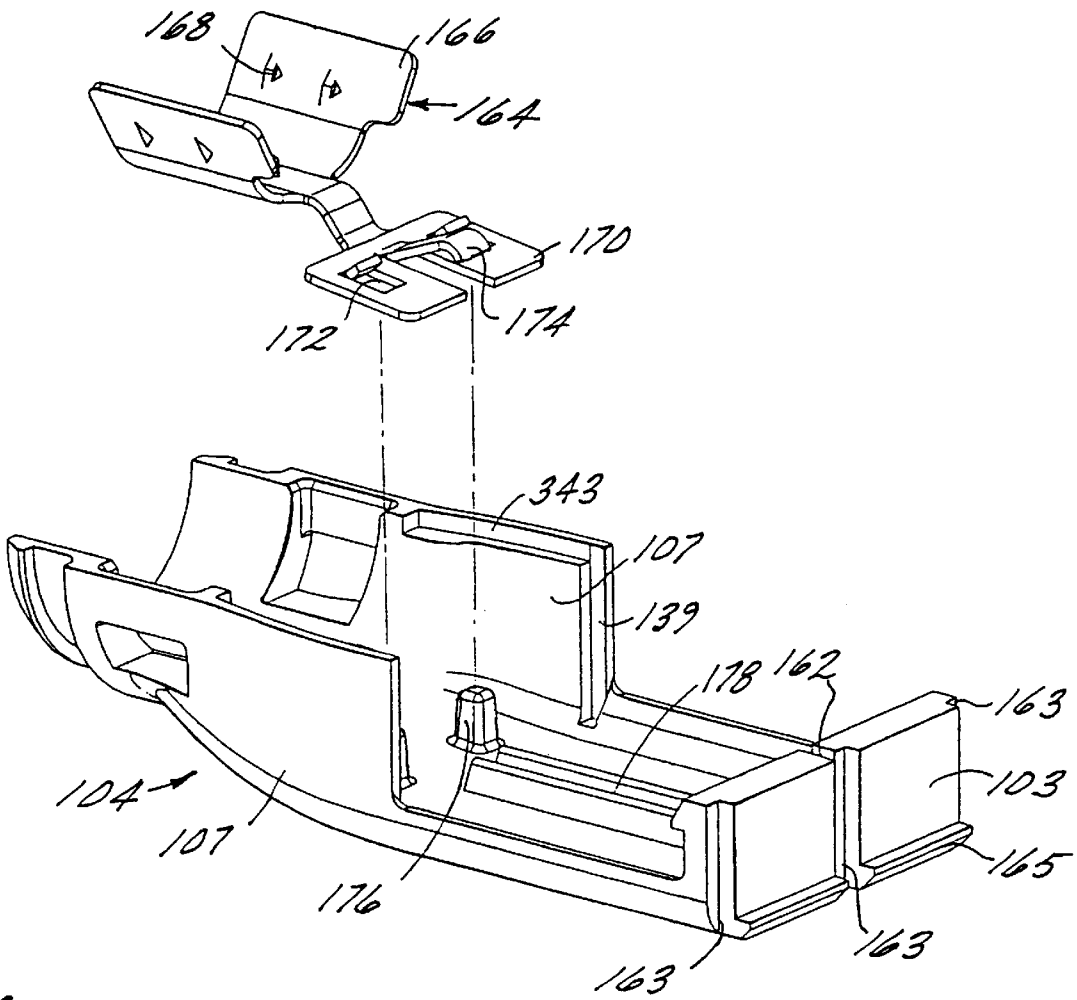
FIG. 4 is an exploded, perspective view of the plug bottom cover.

FIG. 4 is an exploded, perspective view of the bottom cover 104. Bottom cover 104 is similar to top cover 102 in that both use shield contact 164 in the same manner. Bottom cover 104 also includes channel 178 for receiving central ridge 144 on second planar shield 134. As noted above, this allows the central ridge 144 to be overlapped by the sides of the channel 178 and provides better shielding than a conventional butt joint. Notch 162 is provided in the front face 103 of bottom cover 104 to receive second planar shield 134. Bottom cover 104 includes side walls 107 having side wall recess 139, similar to those on top cover 102, for receiving rear extensions 137 on side wall 136. In addition, bottom cover 104 includes second side wall recesses 343 for receiving side wall extensions 143 on top cover 102. The front face 103 of bottom cover 104 is similar to that of top cover 102 and includes recesses 163 for receiving extensions on the front face 317 of the outlet 300. The front face 103 of bottom cover 104 also includes a lip 165, interrupted by recess 163, that overlaps the outside surface of the bottom wall 332 of outlet core 306.

Figure 5:
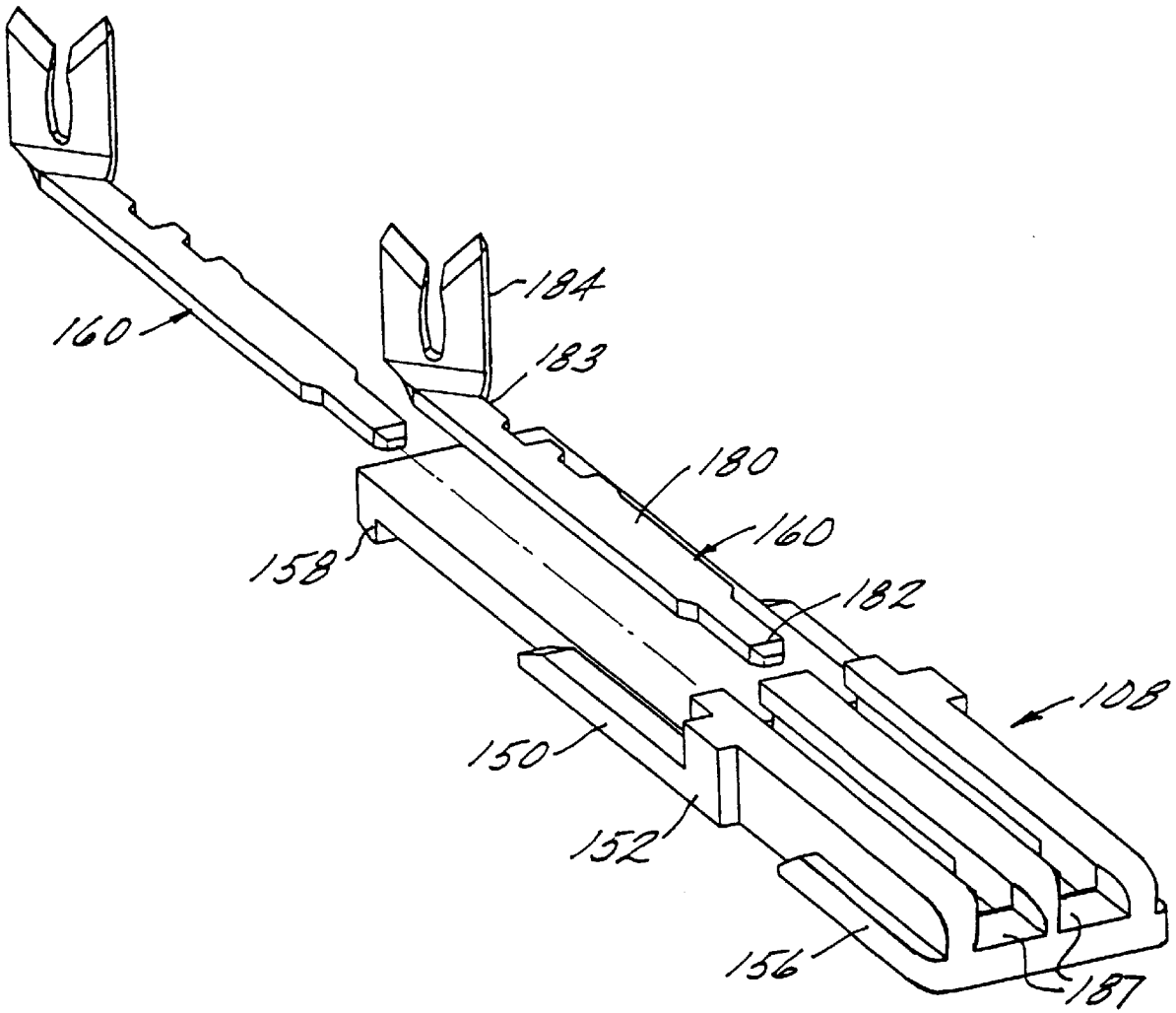
FIG. 5 is an exploded, perspective view of the plug contact carrier.

FIG. 5 is an exploded perspective view of a contact carrier 108. The contact carrier includes two channels 186, each of which receives a contact 160. Each contact 160 has a generally planar body 180, a contact end 182 and a termination end 183. The termination end includes an insulation displacement contact 184 that pierces the insulation of individual wires in cable 10 to make an electrical contact with the wire as is known in the art. Installation of the wires in the insulation displacement contact 184 is described herein with reference to FIGS. 8–10. Each insulation displacement contact is angled relative to the longitudinal axis of body 180 at an angle of 45 degrees. As shown in FIG. 1, the plug 100 includes four contact carriers 108, each having a pair of contacts 160 for a total of eight contacts.

Figure 6:
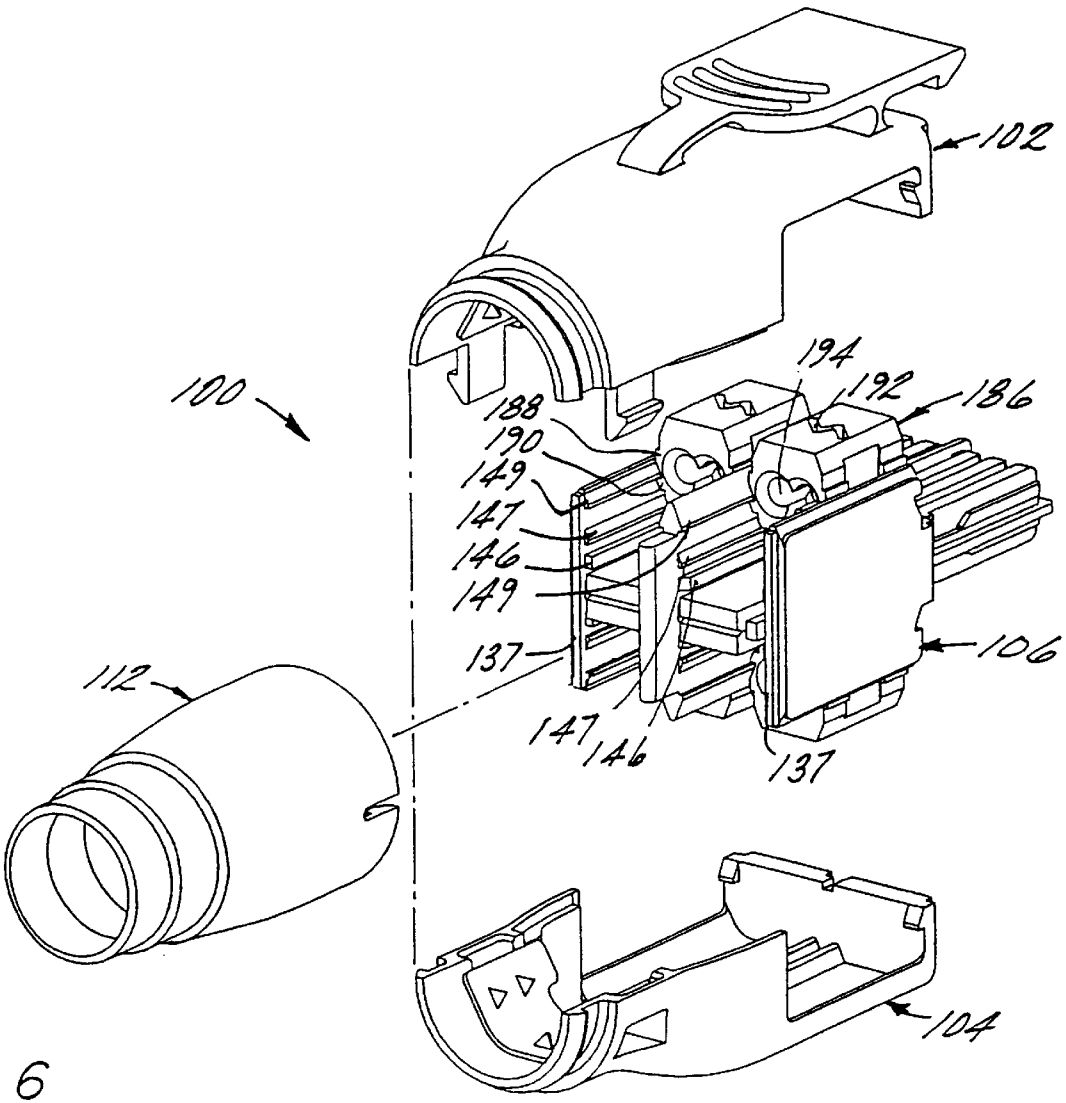
FIG. 6 is an exploded, perspective view of the plug including termination caps.

FIG. 6 is an exploded, perspective view of the plug 100 including termination caps 186. A termination cap 186 is provided for each pair of contacts 160. As is known in the art, a termination cap forces wires onto an insulation displacement contact to pierce the insulation and electrically connect the wire and the insulation displacement contact. Termination cap 186 includes a first lip 188 and a second lip 190 that straddle ledges 149 and 147 on the plug core 106. The first lip 188 and the second lip 190 have a beveled surface and first ledge 149 and second ledge 147 similarly include a beveled surface to facilitate installation of the termination cap 186 as disclosed below. Each termination cap 186 also includes two contact openings 192 for receiving the insulation displacement contacts 184 and a pair of wire openings 194 for receiving wires from cable 10. The wire openings 194 are aligned with the insulation displacement contacts 184 in plug core 106. The plug in FIG. 6 is shown in the state as received by the customer. Termination caps 186 are positioned in the plug core 106 and retained in a first positioned. First lip 188 rests upon first ledge 149 to hold the termination cap 186 in a first position and second lip 190 is positioned beneath first ledge 149 to prevent the termination cap 186 from being inadvertently removed from the plug core 106.

Figure 7:
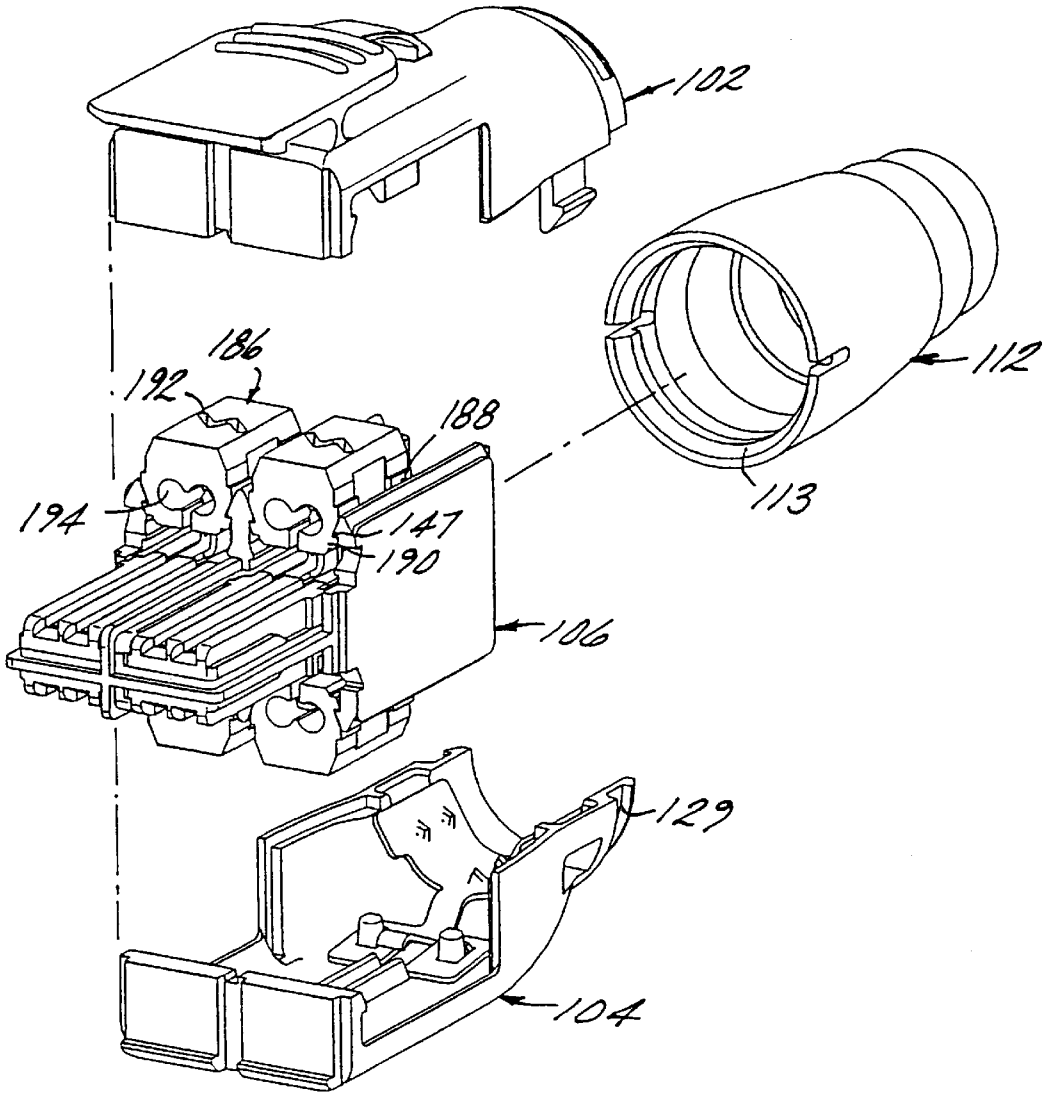
FIG. 7 is another exploded, perspective view of the plug.

FIG. 7 is another exploded, perspective view of the plug 100. As shown in FIG. 7, each termination cap 186 is in the first position by virtue of first lip 188 and second lip 190 straddling first ledge 149. Boot 112 includes a cylindrical lip 113 that engages groove 129 formed in the top cover 102 and the bottom cover 104. Slots 115 may be formed through the boot 122 and perpendicular to lip 113 to allow the lip 113 to expand during installation of the boot 112 and reduce the force needed to install and remove boot 112.

Figure 8:
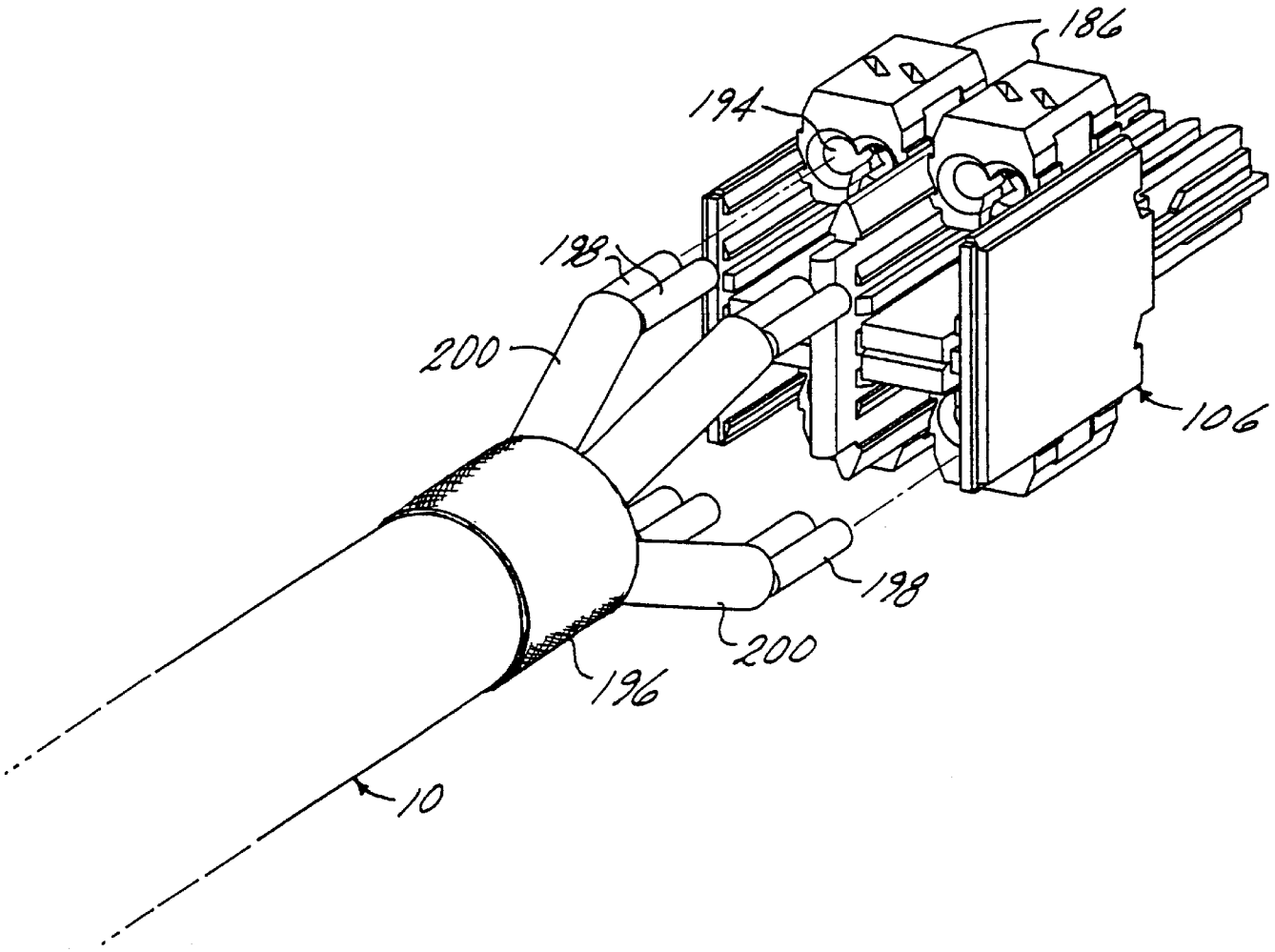
FIG. 8 is a perspective view of the assembly procedure for the plug.
Figure 9:
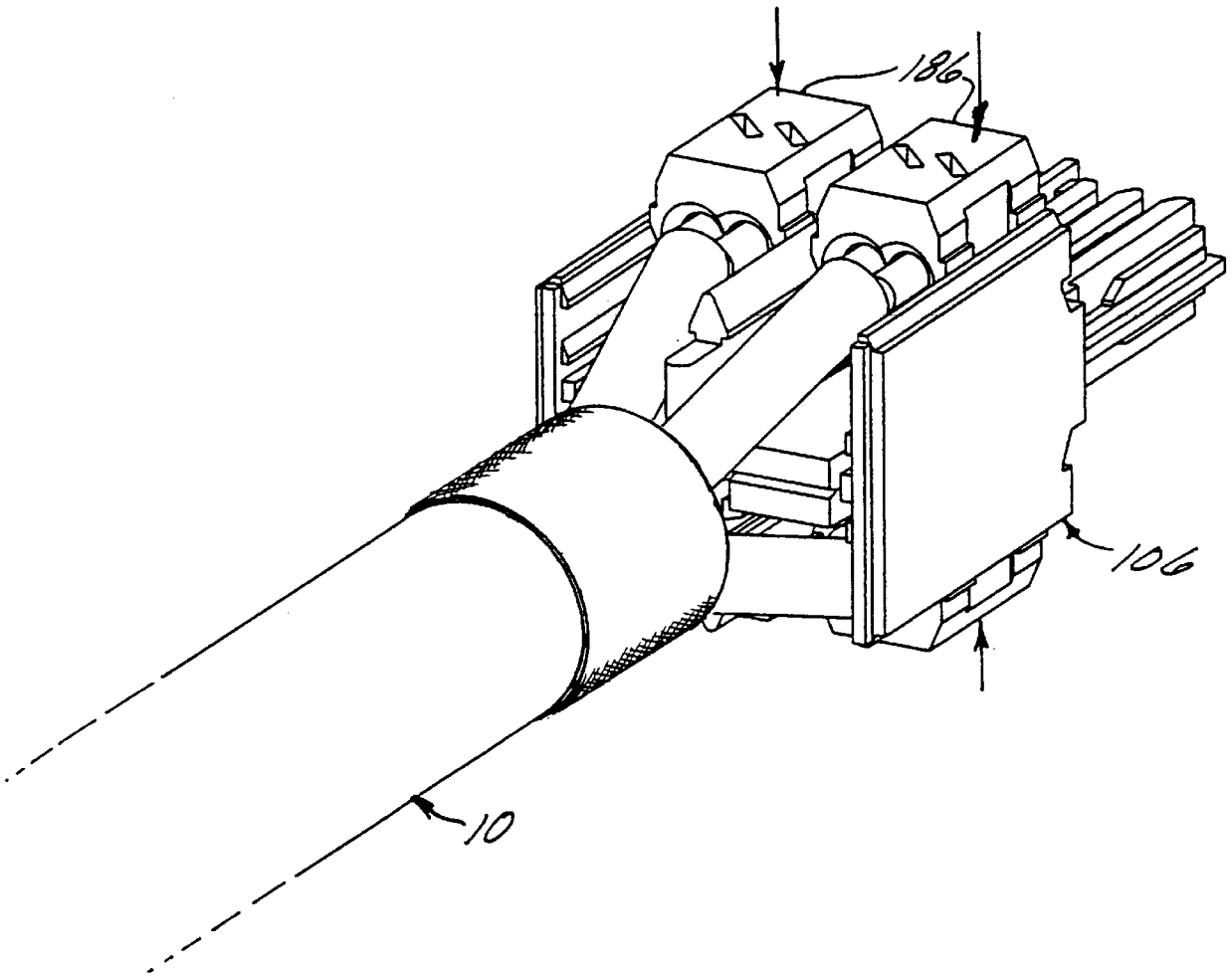
FIG. 9 is a perspective view of the assembly procedure for the plug.

The installation of the wires into the plug 100 will now be described with reference to FIGS. 8–12. As shown in FIG. 8, cable 10 includes eight wires 198. Each pair of wires 198 is encased by a wire pair shield 200. Ground layer 196 is also housed within cable 10 and is pulled back over the outside jacket of cable 10. Wires 198 are inserted into wire openings 194 in termination caps 186. As described above, each wire opening 194 is aligned with an insulation displacement contact 184 and thus each wire 198 is positioned above an insulation displacement contact 184. It is understood that boot 112 is placed over cable 10 prior to inserting wires 198 into termination caps 186. FIG. 9 shows the wires 198 positioned in the wire openings 194. Once the wires 198 are positioned in the termination caps 186, force is applied to each termination cap 186 towards the plug core 106 in the direction shown by the arrows in FIG. 9. A single hand tool can be used to apply force to all four termination caps 186 at the same time to provide for easy installation.

Figure 10:
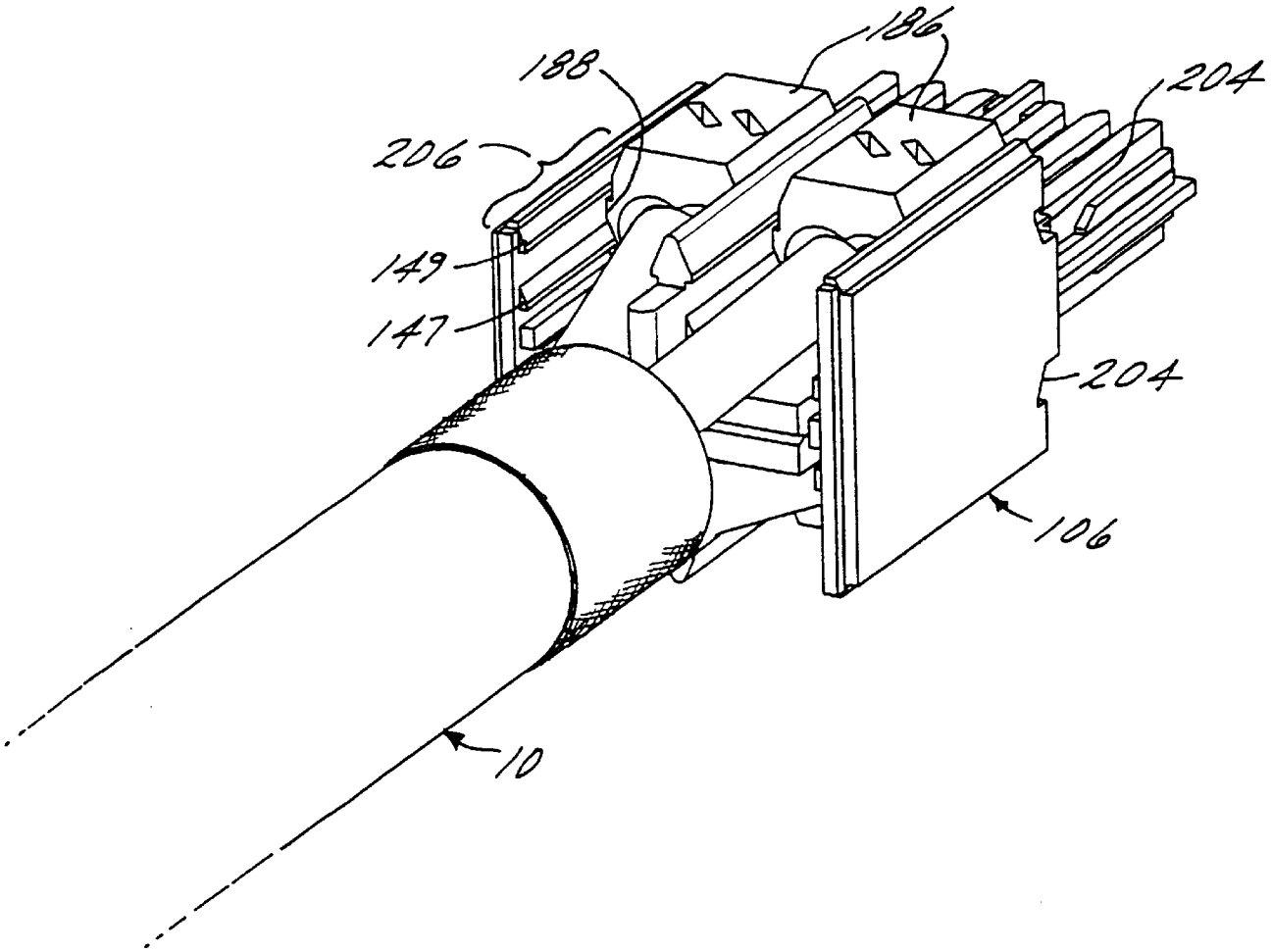
FIG. 10 is a perspective view of the assembly procedure for the plug.

FIG. 10 shows the termination caps 186 in a second position. First lip 188 and second lip 190 now straddle second ledge 147 to hold the termination cap 186 in the second position. In this state, the wires 198 positioned in wire openings 194 are driven onto insulation displacement contacts 184. As is known in the art, the insulation displacement contacts 184 split the insulation on each wire 198 thereby making electrical contact between the wires 198 and the contacts 160. An important aspect of the invention shown in FIG. 10 is the use of a buffer zone 206. The length of the first planar shield 132 and second planar shield 134 is such that a portion of the first planar shield 132 and the second planar shield extend beyond the rear of each termination cap 186 to establish a buffer zone 206. Each wire pair rests in the buffer zone 206. The buffer zone 206 is important because during installation, the wire pair shield 200 is removed so that individual wires can be inserted in wire openings 194. Even assuming that the installer removed the exact recommended length of wire pair shield 200, a small amount of exposed wire will create cross talk between adjacent pairs at frequencies of greater than 600 MHZ. In non-ideal installations, the installer will remove too much of the wire pair shield 200. Thus, the buffer zone 206 reduces cross talk in ideal or non-ideal installations and enhances the connector performance. The buffer zone should have a length, measured from the rear of the termination cap 186, greater than the length of exposed wire 198 (wire pair shield removed) in a worst case installation.

Figure 11:
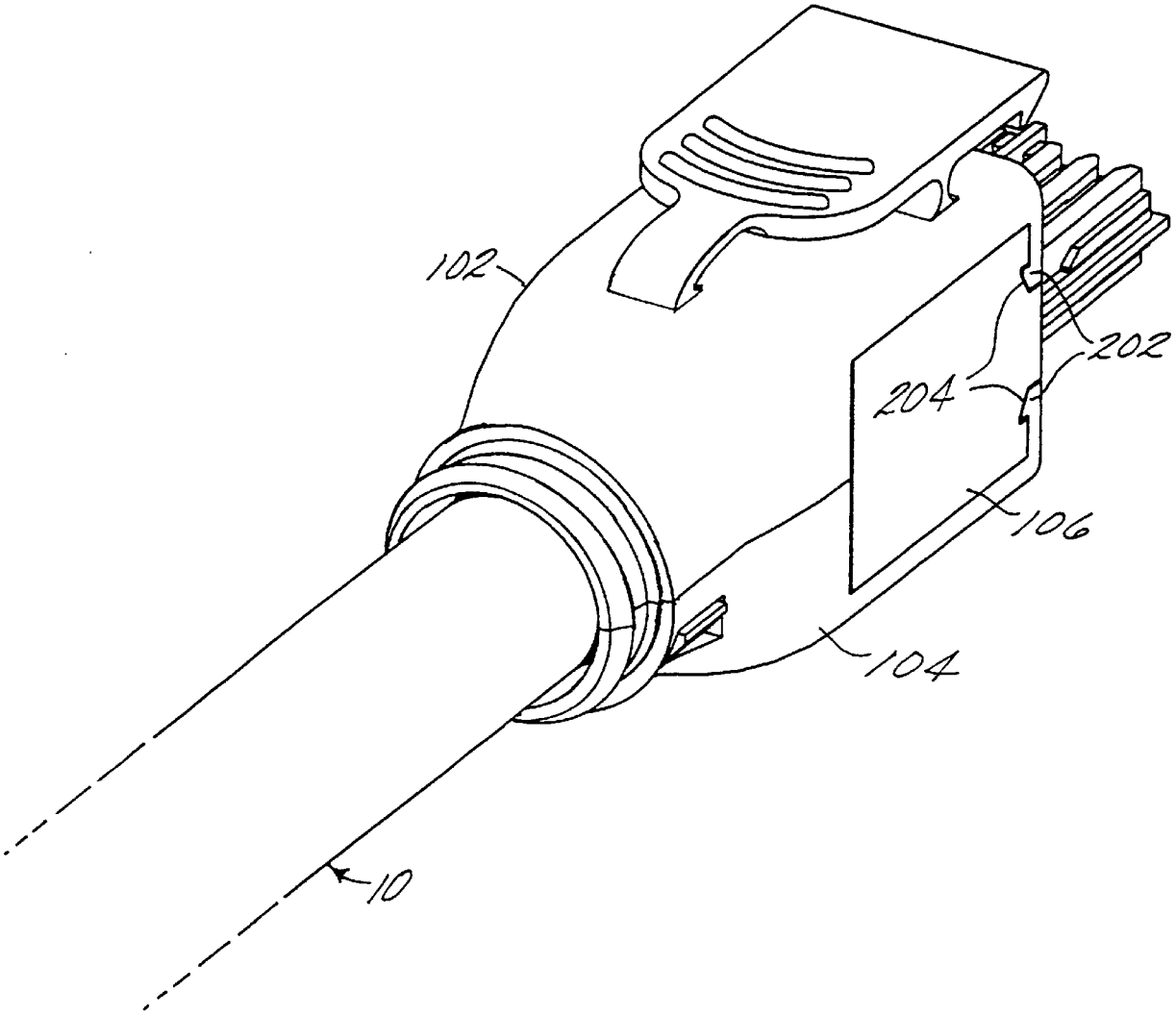
FIG. 11 is a perspective view of the assembly procedure for the plug.
Figure 12:
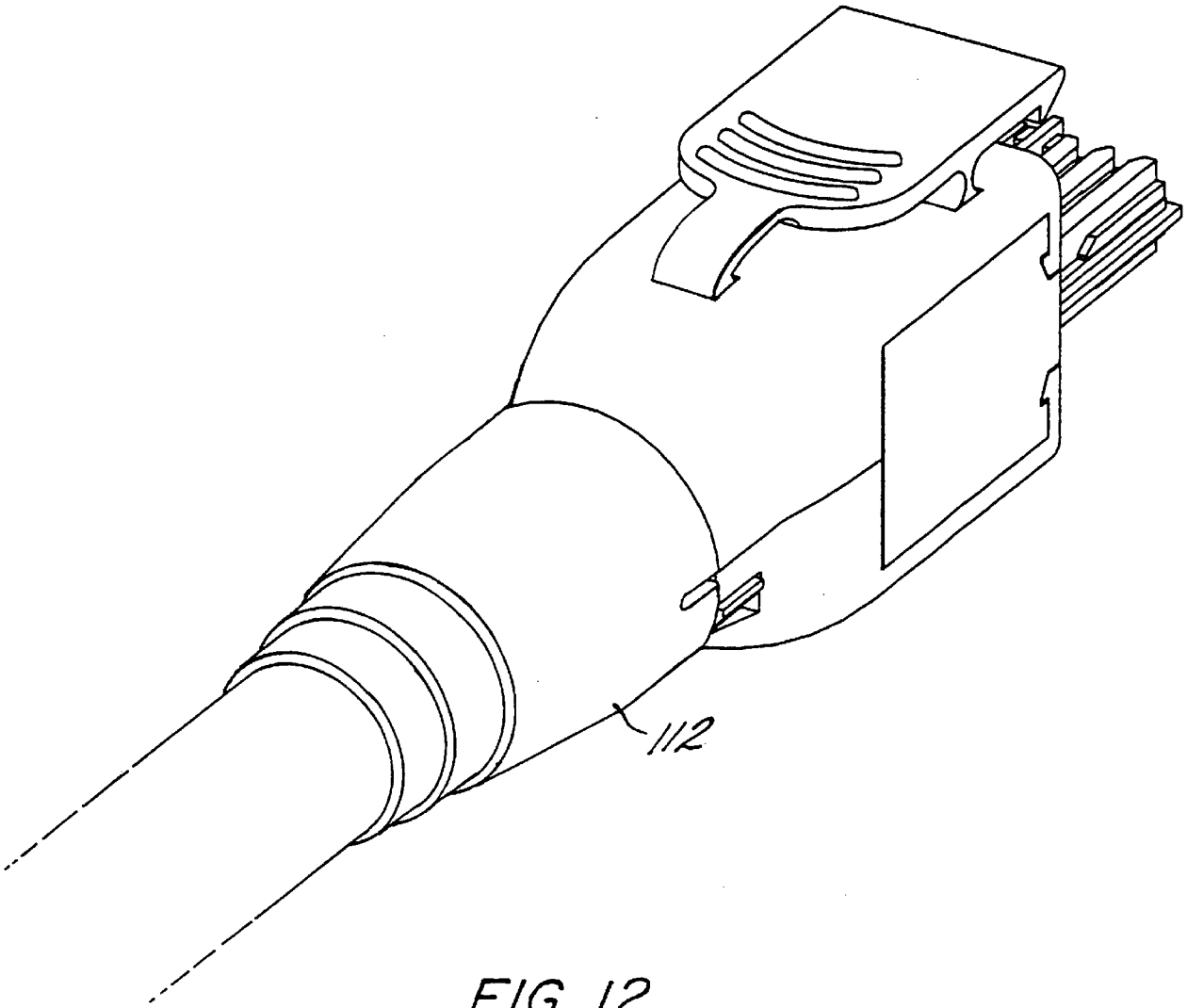
FIG. 12 is a perspective view of the assembly procedure for the plug.

The next step in the installation process is the placement of top cover 102 and bottom cover 104 on plug core 106 as shown in FIG. 11. Top cover 102 and bottom cover 104 each include projections 202 that engage similarly shaped recesses 204 on plug core 106 to secure the top cover 102 and bottom cover 104 to plug core 106. In addition, top cover latches 128 engage bottom cover openings 130 to secure the top cover 102 to the bottom cover 104. Barbs 168 on shield contacts 164 penetrate the ground layer 196 and the cable jacket to mechanically and electrically connect the shield connectors 164 to cable 10. The final step in the plug assembly is securing the boot 112 to the plug. As shown in FIG. 12, the boot 112 is snapped onto the top and bottom covers. Lip 113 on the inside surface of boot 112 engages the groove 129 formed in top cover 102 and bottom cover 104.

Figure 12A:
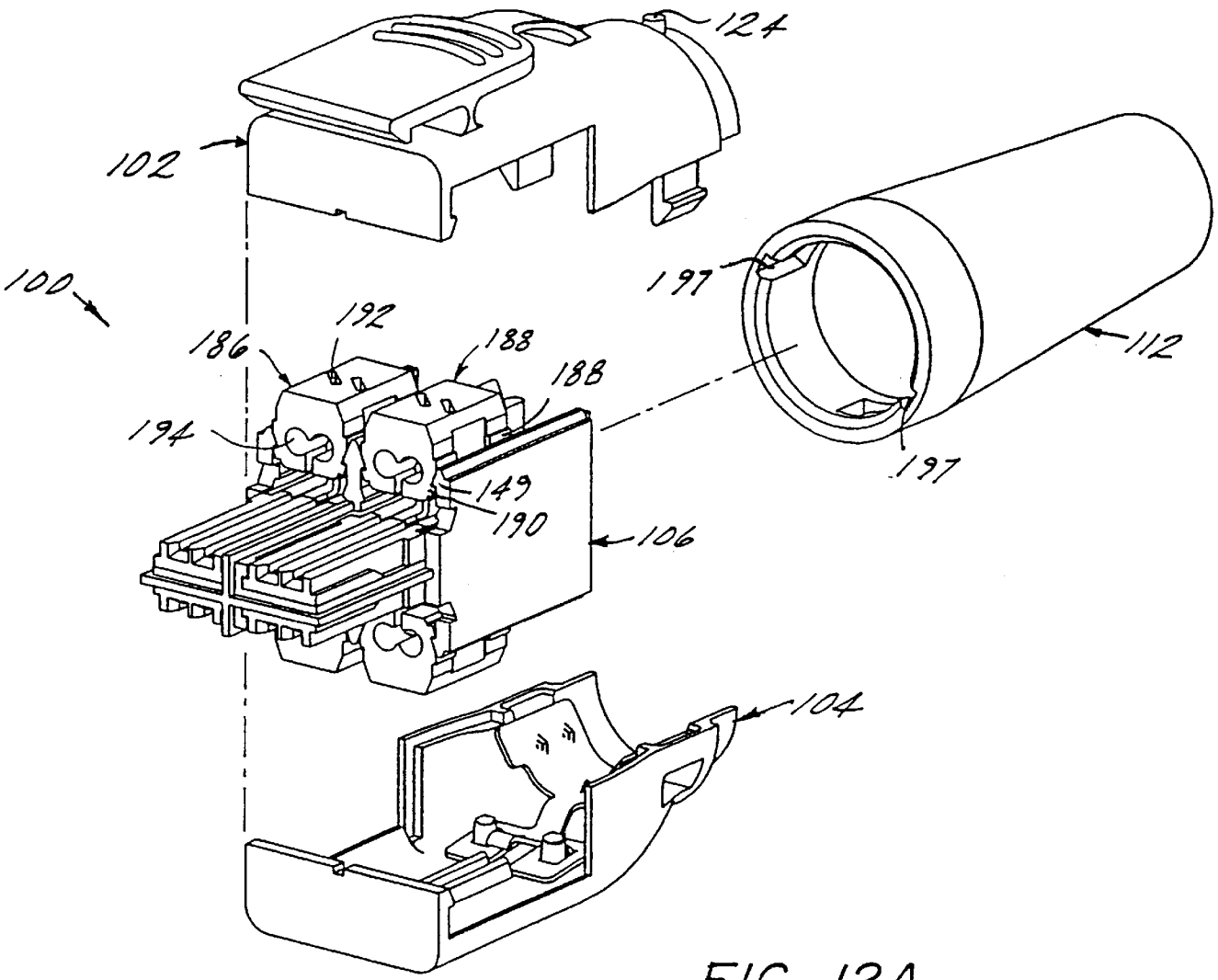
FIG. 12A is a perspective view of an alternative embodiment of the plug.
Figure 12B:
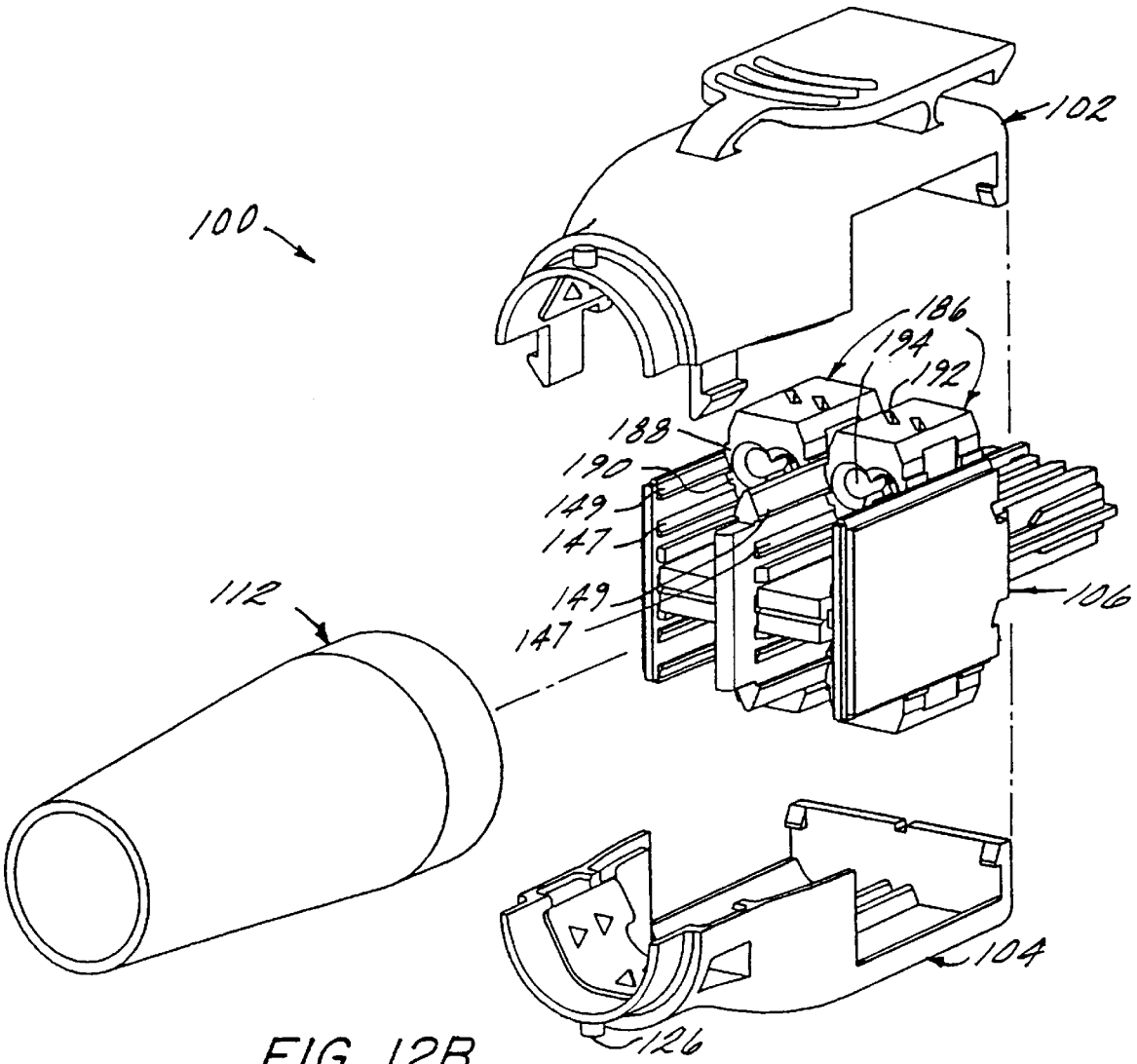
FIG. 12B is a perspective view of the alternative embodiment of the plug.

FIG. 12A is a perspective view of the plug in an alternative embodiment. As can be seen in FIG. 12A, boot 112 includes two L-shaped channels 197 which receive post 124 formed on the top cover 102 and post 126 formed on the bottom cover 104 (FIG. 12B). Boot 112 is secured to the top cover 102 and bottom cover 104 by placing posts 124 and 126 in channels 197 and rotating the boot 112.

Figure 13:
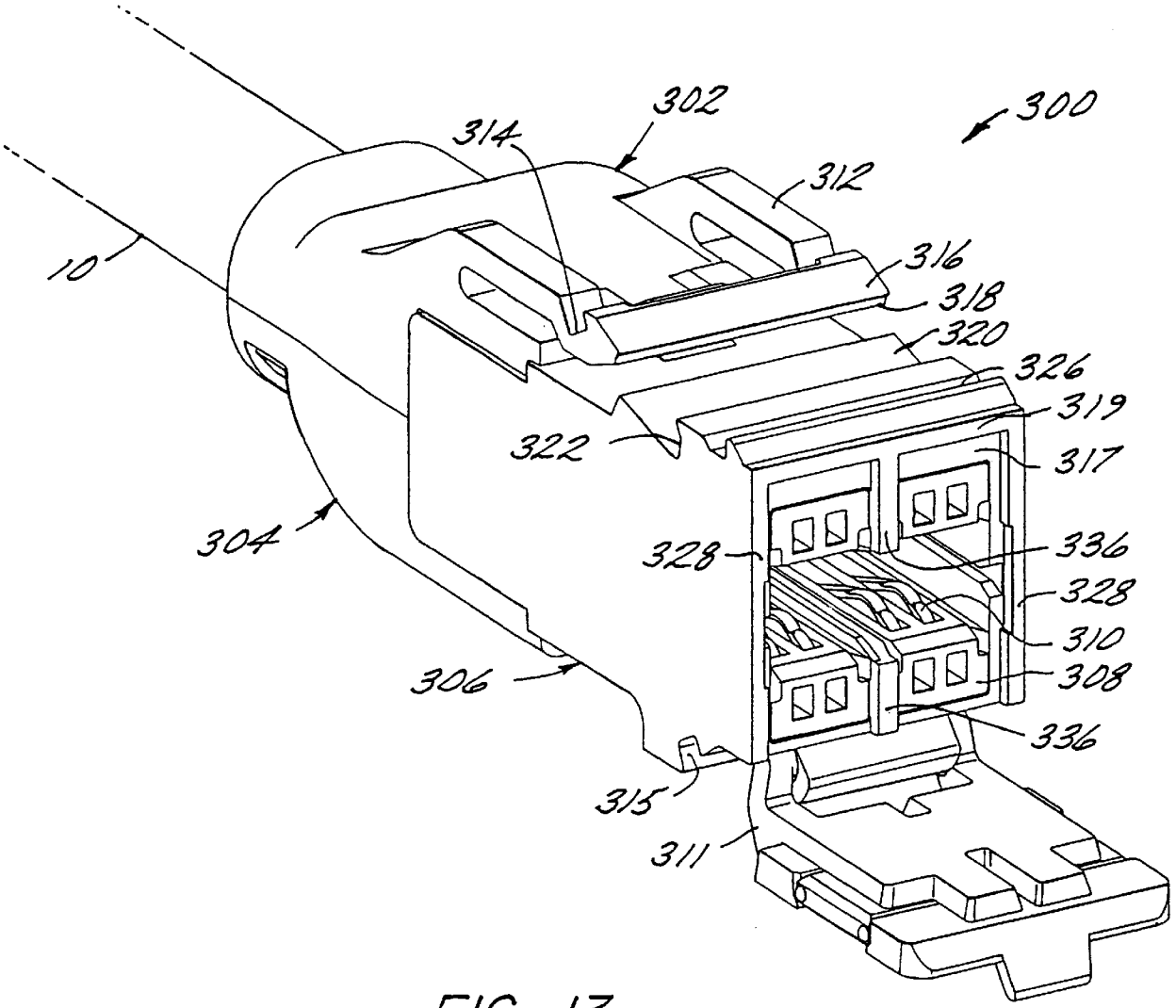
FIG. 13 is a perspective view of the outlet.

FIG. 13 is a perspective view of an outlet 300 for use with plug 100. The outlet 300 includes a top cover 302, a bottom cover 304 and a core 306. The top cover 302, bottom cover 304 and core 306 are all conductive to provide shielding as described herein. These conductive components may be made from metal, metallized plastic or any other known conductive material. Core 306 supports insulative contact carriers 308. Each contact carrier includes contacts 310. An optional door 311 is also provided to prevent contamination (e.g. dust) from entering outlet 300.

Top cover 302 includes a pair of resilient arms 312 having notches 314 formed therein. Notches 314 receive the edge of a faceplate as will be described below with reference to FIG. 23. Another notch 315 is formed on the bottom of outlet core 306 for receiving another edge of the faceplate. Notches 314 and 315 lie in a plane that is at an oblique angle relative to the front face 317 of outlet 300. When mounted in a faceplate, this directs the outlet towards the ground and provides for a gravity feed design. The gravity feed reduces the bend angle of the cable connected to plug 100 and reduces the likelihood that the cable will be bent beyond the minimum bend radius and cause signal degradation or loss. Alternatively, notches 314 and 315 may lie in a plane parallel to the front face 317 of outlet 300. A member 316 connects the ends of resilient arms 314 and includes a recess 318 on a front face thereof. Recess 318 receives one edge of an identification icon 324 (shown in FIG. 14). The identification icon 324 rests on support surface 320 and engages a recess 322. Both support surface 320 and recess 322 are formed on the outlet core 306.

Figure 14:
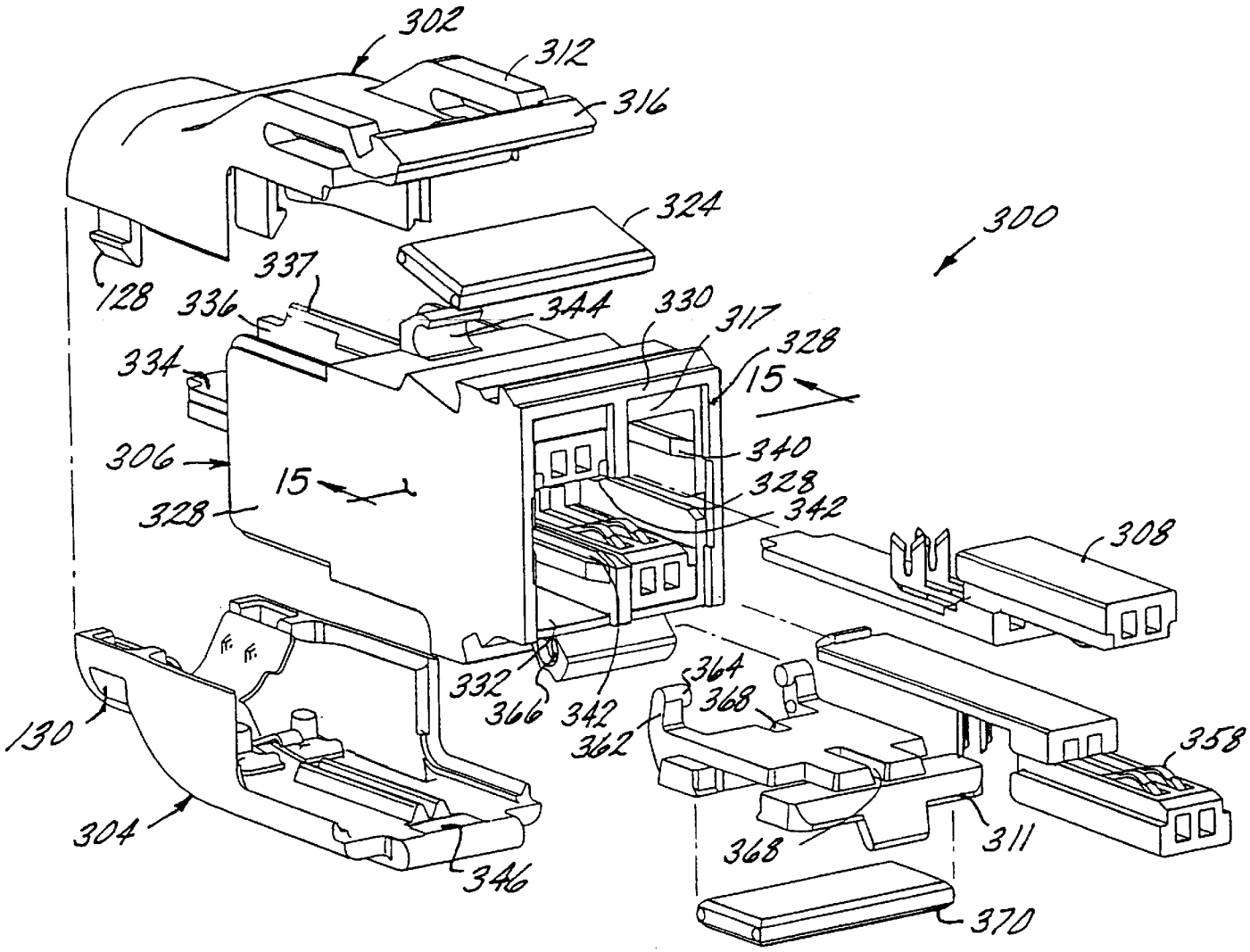
FIG. 14 is an exploded, perspective view of the outlet.

FIG. 14 is an exploded, perspective view of outlet 300. Top cover 302 includes top cover latches 128 that engage bottom cover openings 130 as described above. Outlet core 306 is generally rectangular and includes side walls 328, top wall 330 and bottom wall 332. A first planar shield 334 extends from the rear of the outlet core and terminates within the interior of the outlet core 306 as will be described below. Second planar shield 336 extends the entire length of the outlet core 306 but includes an open region for receiving plug 100 and overlapping the second planar shield 134 in plug 100. Side walls 328 include grooves 338 for receiving first planar shield 132 of plug 100. Side walls 328 and second planar shield 336 include ribs 340 for securing contact carriers 308 to outlet core 306. Second planar shield 336 includes shield extensions 342 having a reduced thickness and extending away from and parallel to second planar shield 336. As will be described below in detail, shield extensions 342 overlap the edges of second planar shield 134 when the plug 100 is mated with outlet 300. Second planar shield 336 also includes a ridge 337 on its top and bottom for engaging channels 178 formed in the outlet top cover 302 and the outlet bottom cover 304. In addition, side walls 328 and second planar shield 336 extend beyond the front face 317 of outlet 300 and engage recesses 163 formed in the front face 103 of the outlet 100. Top wall 330 extends beyond the front face 317 of outlet 300 and overlaps the front face 103 of plug top cover 102. Lip 165 on plug bottom cover 104 overlaps bottom wall 332.

Door 311 includes two arms having inwardly facing pins 364 that are received in holes 366 on outlet core 306. A pair of slots 368 are formed on the inside surface of door 311 for receiving the first planar shield 336 in outlet core 306. An identification icon 370 can be mounted to the front of door 311 as described in copending U.S. patent application Ser. No. 08/652,230, the contents of which are incorporated herein by reference.

Figure 15:
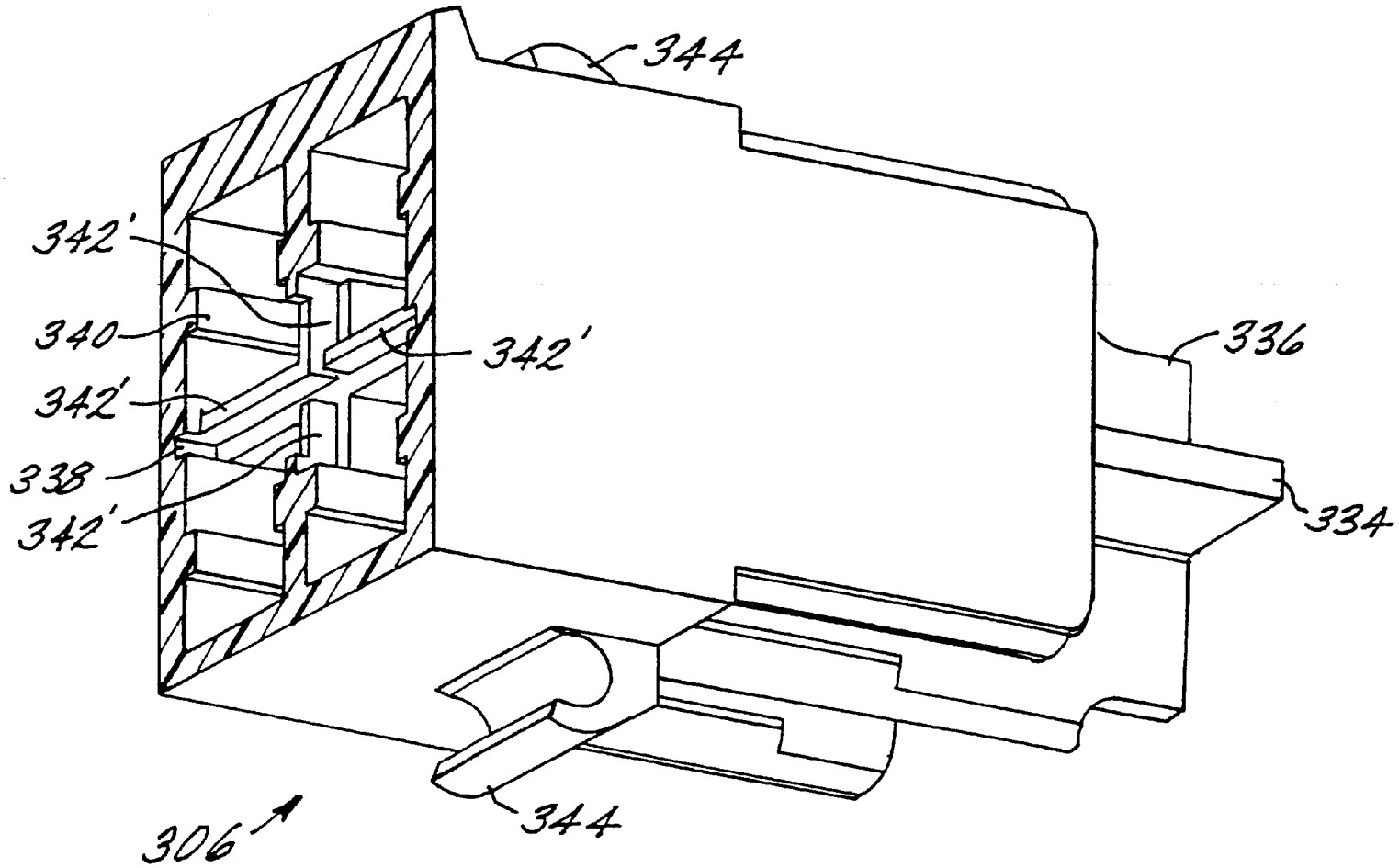
FIG. 15 is a cross-sectional view of the outlet core.

FIG. 15 is a cross-sectional view of outlet core 306 along line 15—15 of FIG. 14. As shown in FIG. 15, the first planar shield 336 and second planar shield 338 include shield extensions 342' that overlap the ends 133 and 135 of the first planar shield 132 and second planar shield 134 in plug 100. Shield extensions 342' have a thickness that is less than the thickness of the first planar shield 336 or the second planar shield 338. Hooks 344 on the top and bottom of outlet core 306 engage openings 346 in the top cover 302 and the bottom cover 304.

Figure 16:
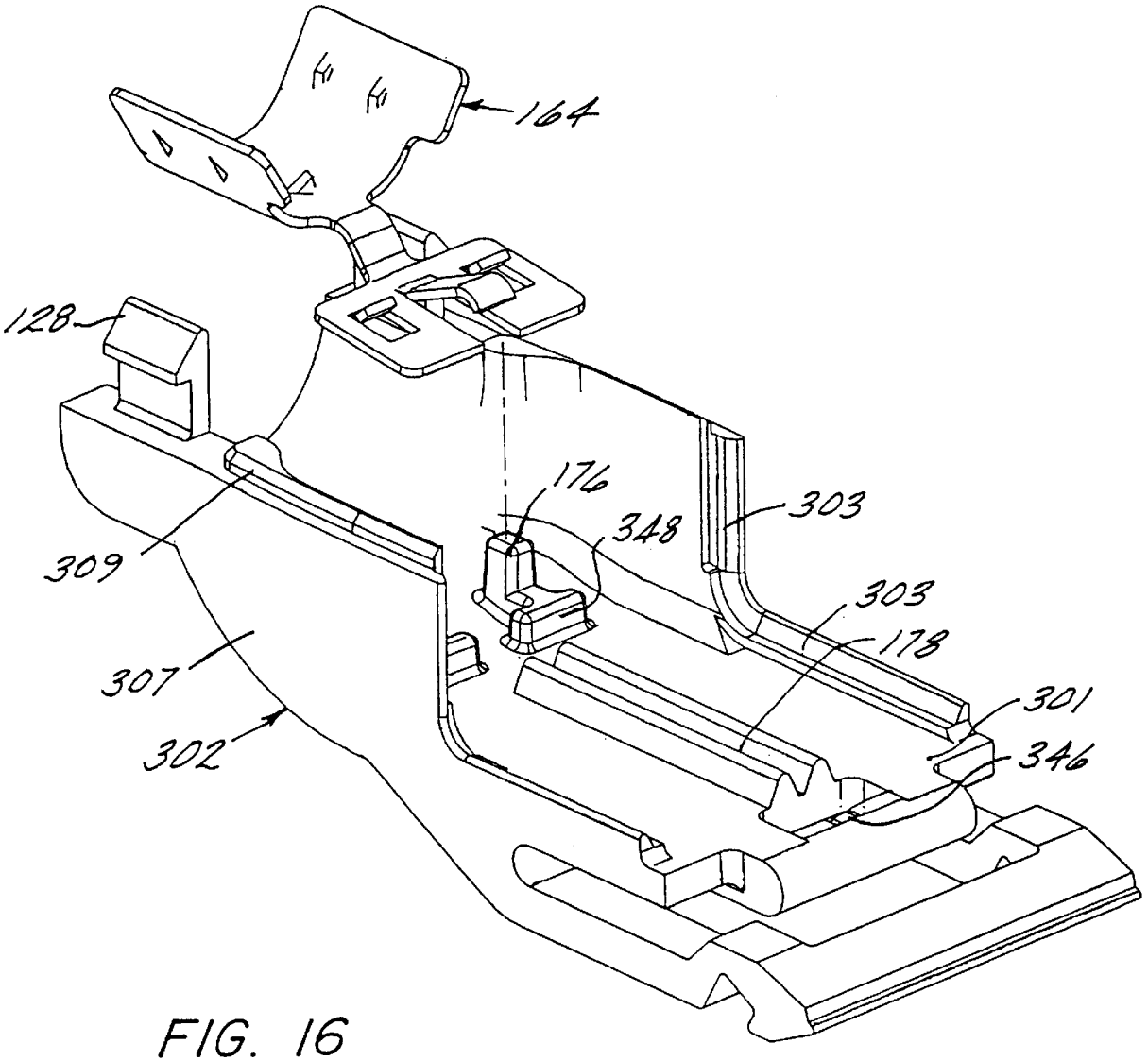
FIG. 16 is an exploded, perspective view of the outlet top cover.
Figure 19:
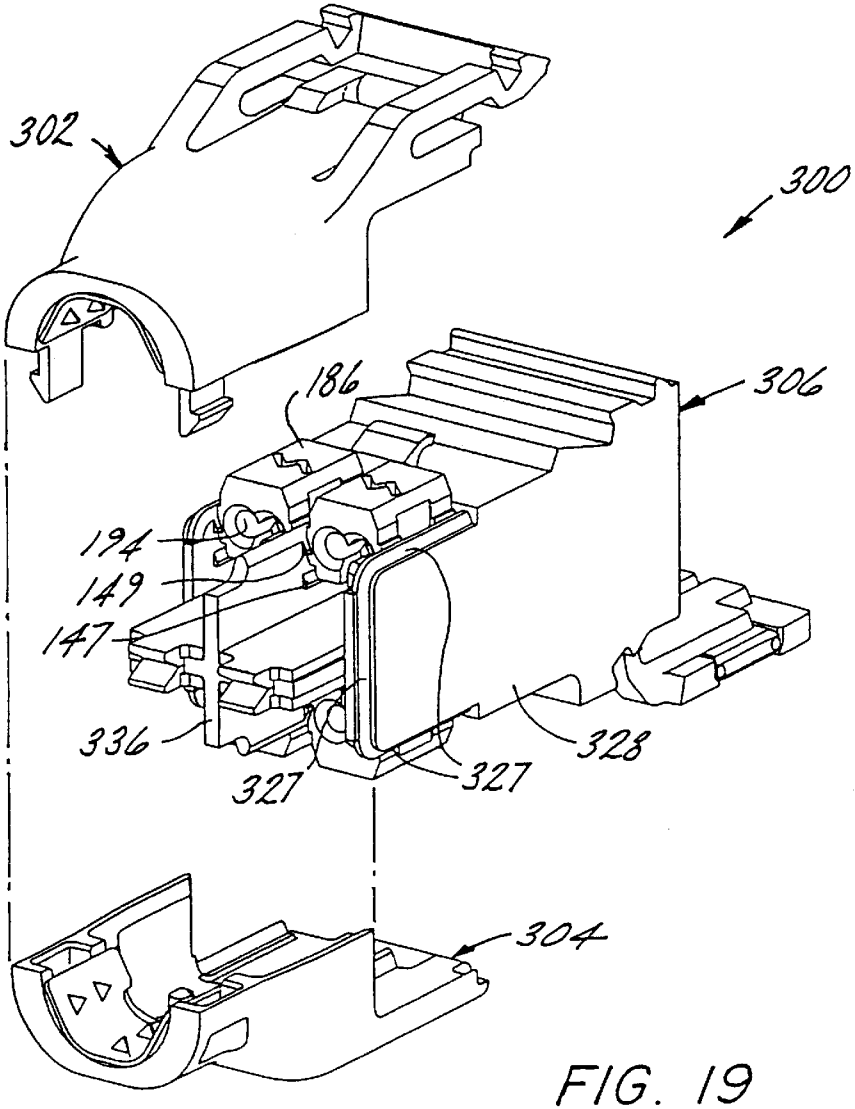
FIG. 19 is an exploded, perspective view of the outlet including termination caps.

FIG. 16 is an exploded, perspective view of top cover 302. Top cover 302 includes the shield contact 164 described above with reference to plug 100. Top cover 302 additionally includes projections 348 to support the shield contact 164 due to the different geometry of the outlet 300. Top cover 302 includes recesses 303 along a top wall 301 and a side wall 307 for receiving extensions 327 on the outlet core 306 (FIG. 19). Side walls 307 include projections 309 that are received in recesses 313 on bottom cover 304. A channel 178 is provided on top wall 301 for receiving ridge 337 on second planar shield 336.

Figure 17:
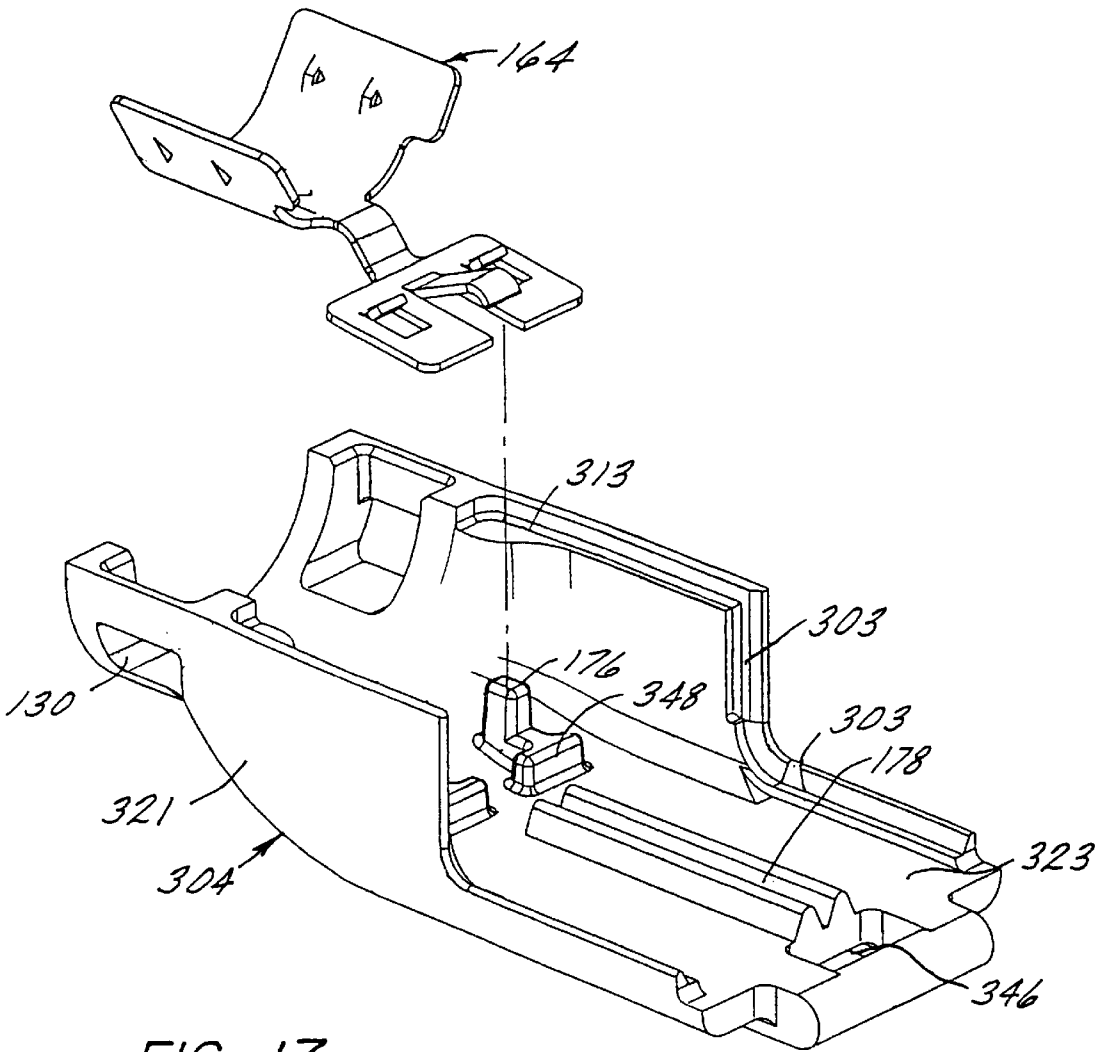
FIG. 17 is an exploded, perspective view of the outlet bottom cover.

FIG. 17 is an exploded perspective view of bottom cover 304. Bottom cover 304 includes the shield contact 164 described above with reference to plug 100. Bottom cover 304 additionally includes projections 348 to support the shield contact 164 due to the different geometry of the outlet 300. Recesses 303 are formed on the bottom cover bottom wall 323 and side wall 321 and receive extensions 327 (FIG. 19) on the side walls 328 of outlet core 306. Side walls 321 further include recesses 313 for receiving projections 309 on top cover 302. A channel 178 is provided on bottom wall 323 for receiving ridge 337 on second planar shield 336.

Figure 18:
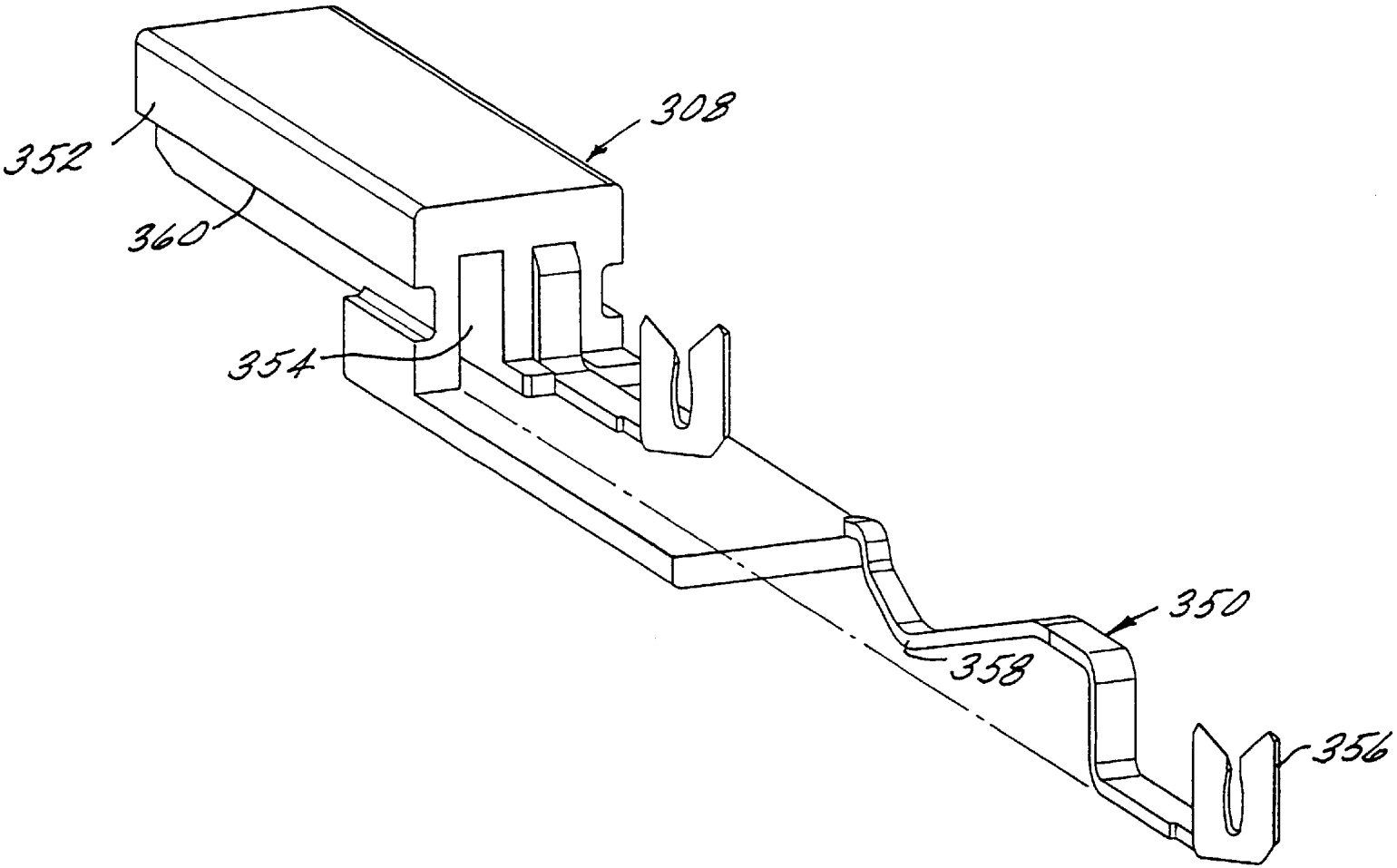
FIG. 18 is an exploded, perspective view of the outlet contact carrier.

FIG. 18 is an exploded, perspective view of contact carrier 308. The contact carrier is insulative and includes a generally rectangular housing 352 having a pair of slots 354 formed therein for receiving contacts 350. The slots 354 are formed through one surface of housing 352 so that a portion of the contact 350 extends beyond the surface of the housing 352 as shown in FIG. 14. The contact 350 includes an insulation displacement contact 356 at one end for piercing the insulation of a wire and making electrical contact. Insulation displacement contact 356 is angled relative to the longitudinal axis of the contact 350 at an angle of 45 degrees. Contact 350 also includes a spring portion 358 that extends beyond the surface of the housing 352 as shown in FIG. 14. When the plug and outlet are mated, the contacts 110 in plug 100 contact the spring portion 358 of contacts 350 in outlet 300 and deflect the spring portion 358 towards housing 352. The spring portion 358 is biased against contact 110 and ensures good electrical contact between the plug 100 and outlet 300. Housing 352 includes shoulder 360 that contacts rib 340 on outlet core 306 to secure the contact carrier 308 to the outlet core 306.

FIG. 19 is an exploded, perspective view of the outlet 300. Termination caps 186 are used to install wires onto the insulation displacement contacts 356. Termination caps 186 are identical to those described above with reference to the plug 100. Outlet 300 includes first ledges 149 and a second ledges 147 formed on the side walls 328 and second planar shield 336. As described above with reference to plug 100, the termination cap 186 is held in a first position by first lip 188 and second lip 190 straddling first ledge 149. Wire openings 194 receive wires 198 and are aligned with insulation displacement contacts 356. As described above, side walls 328 include extensions 327 on the top, bottom and rear side thereof for engaging recesses 303 on outlet top cover 302 and outlet bottom cover 304.

Figure 20:
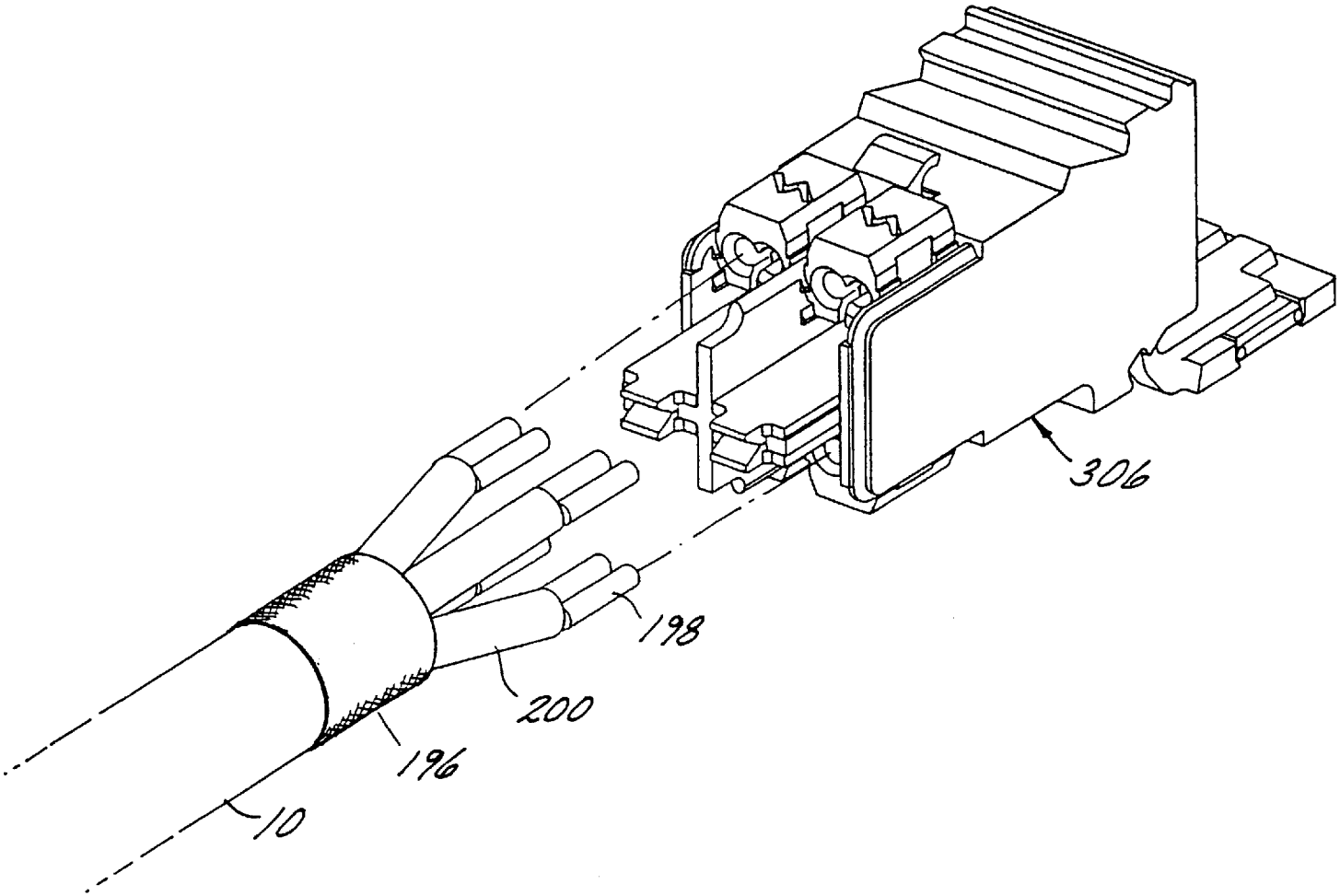
FIG. 20 is a perspective view of the assembly procedure for the outlet.

The installation of the wires into the outlet 300 will now be described with reference to FIGS. 20–22. As shown in FIG. 20, cable 10 includes eight wires 198. Each pair of wires 198 is encased by a wire pair shield 200. Ground layer 196 is also housed within cable 10 and is pulled back over the outside jacket of cable 10. Wires 198 are inserted into wire openings 194 in termination caps 186. As described above, each wire opening 194 is aligned with an insulation displacement contact 356 and thus each wire 198 is positioned above an insulation displacement contact 356.

Figure 21:
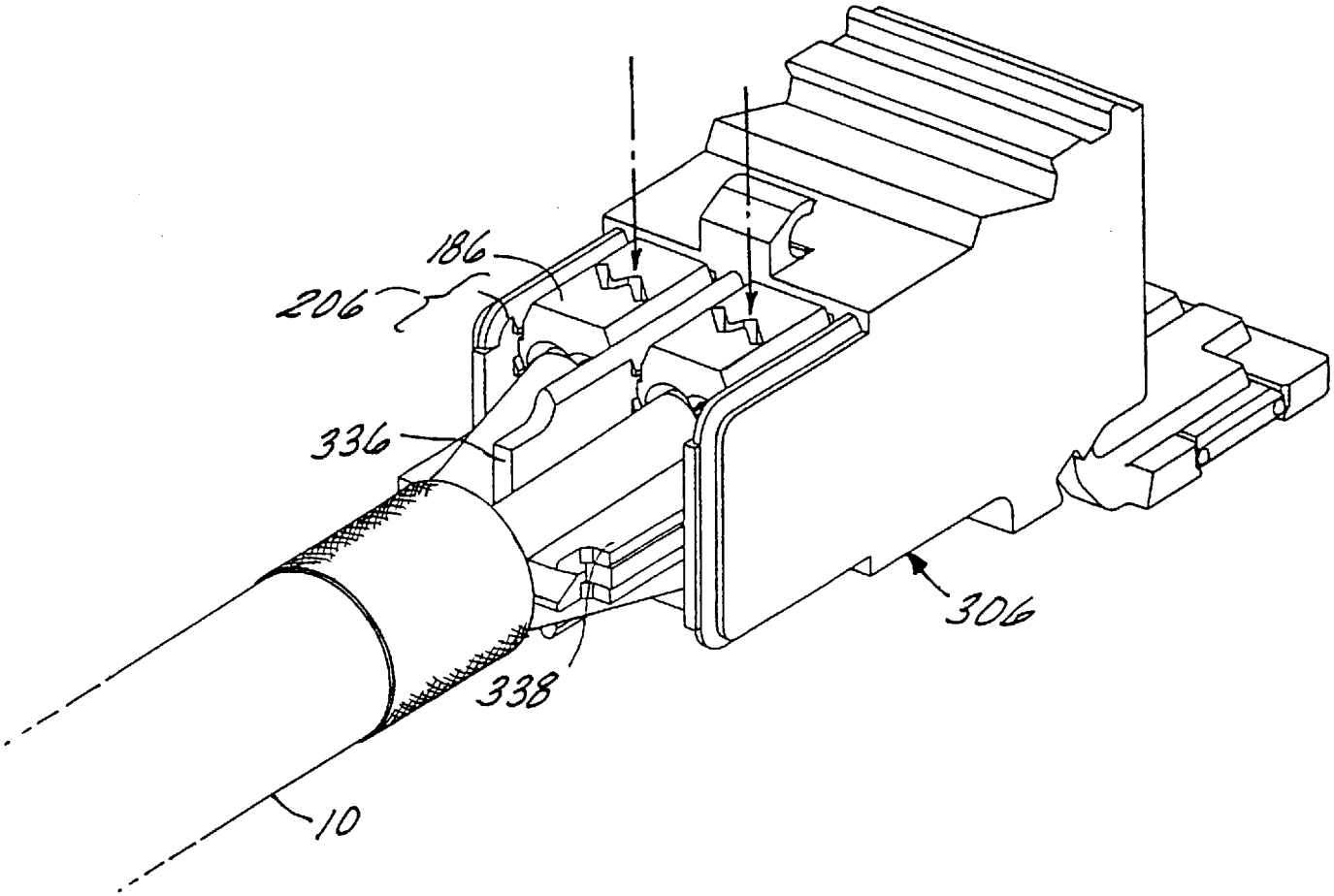
FIG. 21 is a perspective view of the assembly procedure for the outlet.

FIG. 21 shows the wires 198 positioned in the wire openings 194. Once the wires 198 are positioned in the termination caps 186, force is applied to each termination cap 186 towards the outlet core 306 in the direction shown by the arrows in FIG. 21. As discussed above with reference to plug 100, a single tool can apply force to all four termination caps at once. FIG. 21 shows the termination caps 186 in a second position. First lip 188 and second lip 190 now straddle second ledge 147 to hold the termination cap 186 in the second position. In this state, the wires 198 positioned in wire openings 194 are driven onto insulation displacement contacts 356. As is known in the art, the insulation displacement contacts 356 split the insulation on each wire 198 thereby making electrical contact between the wires 198 and the contacts 350. The outlet 300 also includes a buffer zone 206 similar to that described above with reference to plug 100. A portion of first planar shield 336 and the second planar shield 338 extend past the termination caps 186 to provide the buffer zone 206 having the advantages described above with reference to plug 100.

Figure 22:
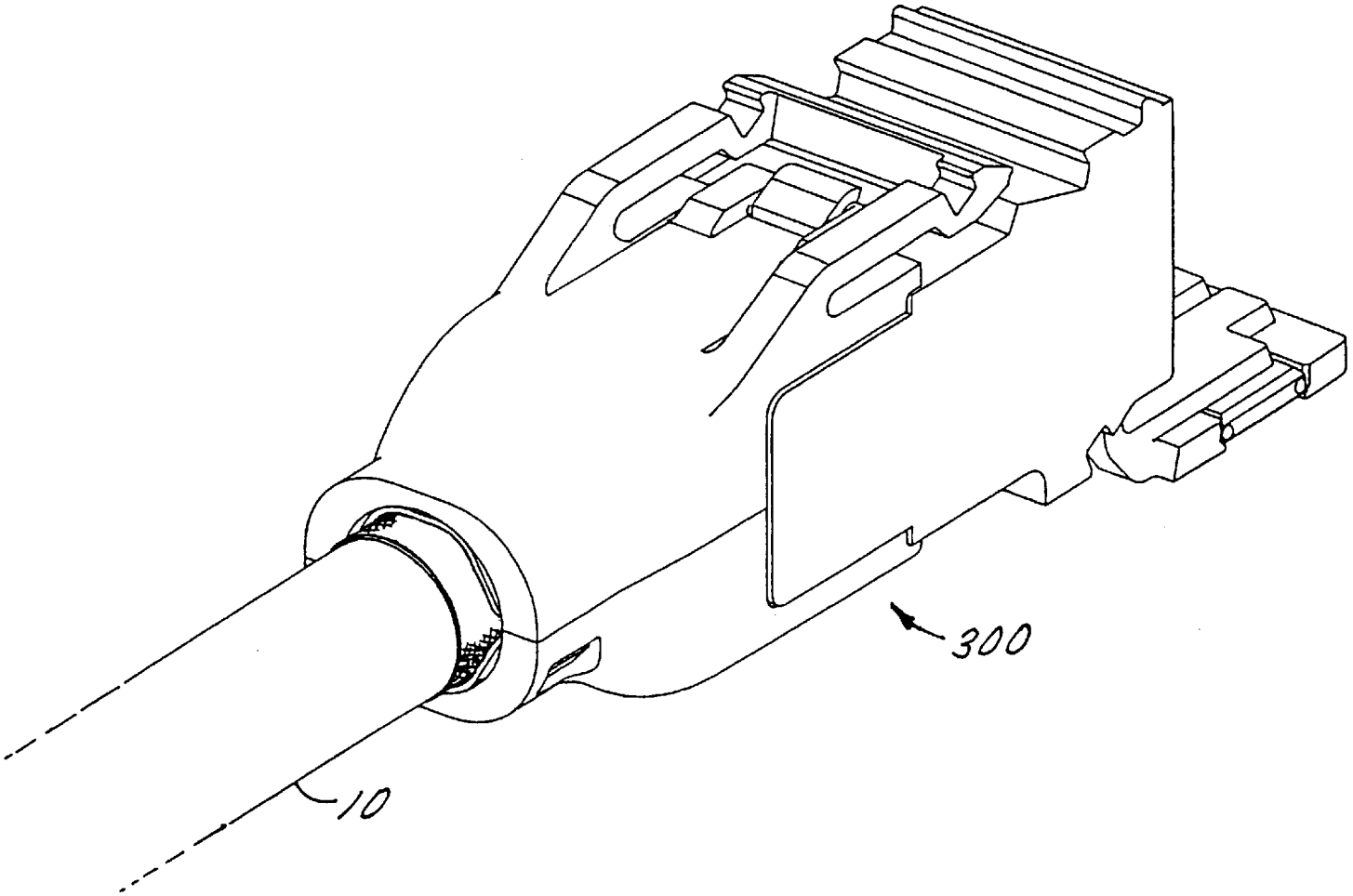
FIG. 22 is a perspective view of the assembly procedure for the outlet.

The next step in the installation process is the placement of top cover 302 and bottom cover 304 on outlet core 306 as shown in FIG. 22. The opening 346 in both the top cover 302 and the bottom cover 304 is placed over a respective hook 344. The top cover 302 and the bottom cover 304 are then rotated towards each other and top cover latches 128 engage bottom cover openings 130 to secure the top cover 302 to the bottom cover 304. Barbs 168 on shield contacts 164 penetrate the ground layer 196 and the jacket of cable 10 to mechanically and electrically connect the shield contacts 164 to the cable 10.

Figure 23:
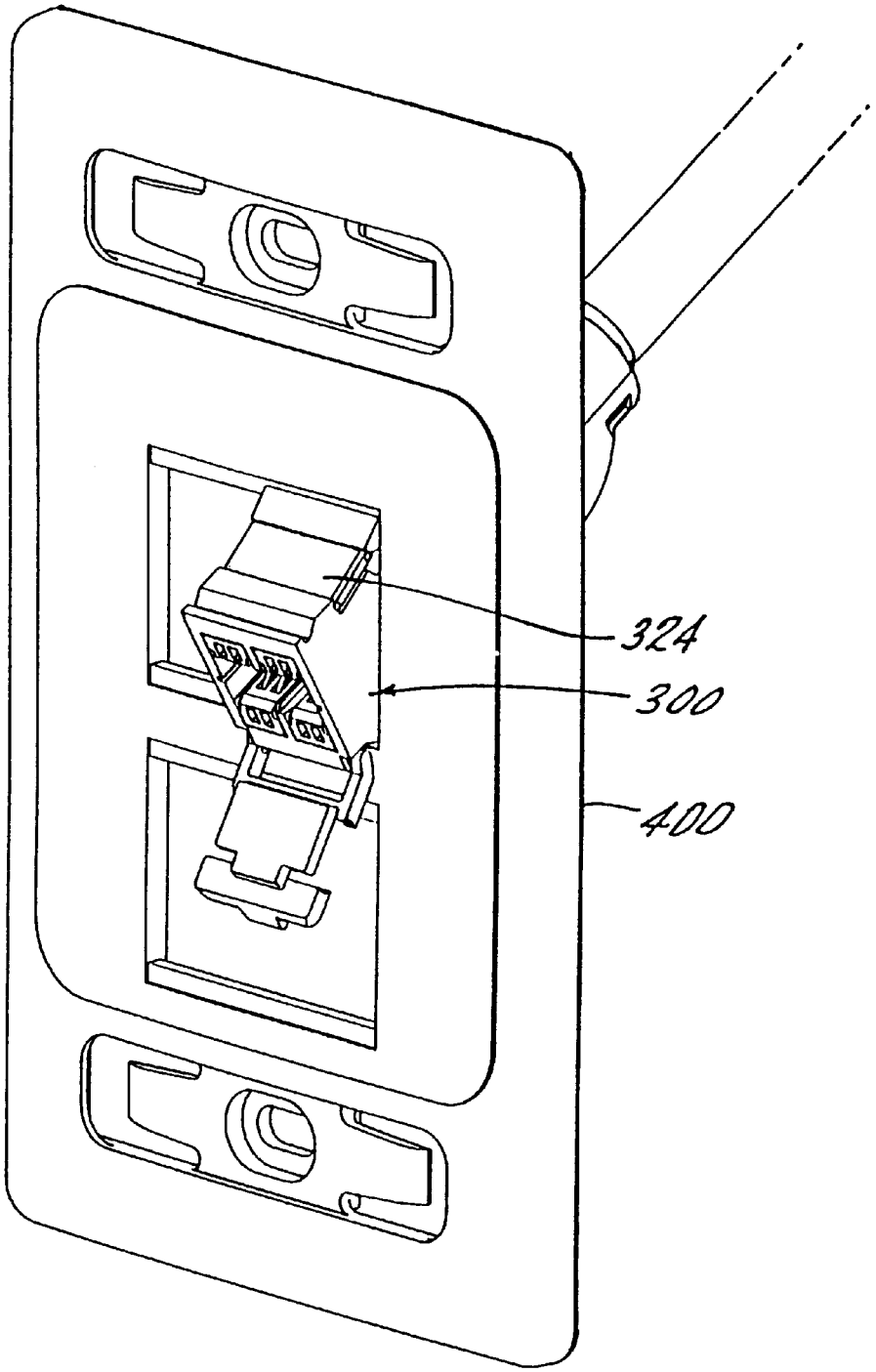
FIG. 23 is a perspective view of the outlet mounted in a faceplate.
Figure 24:
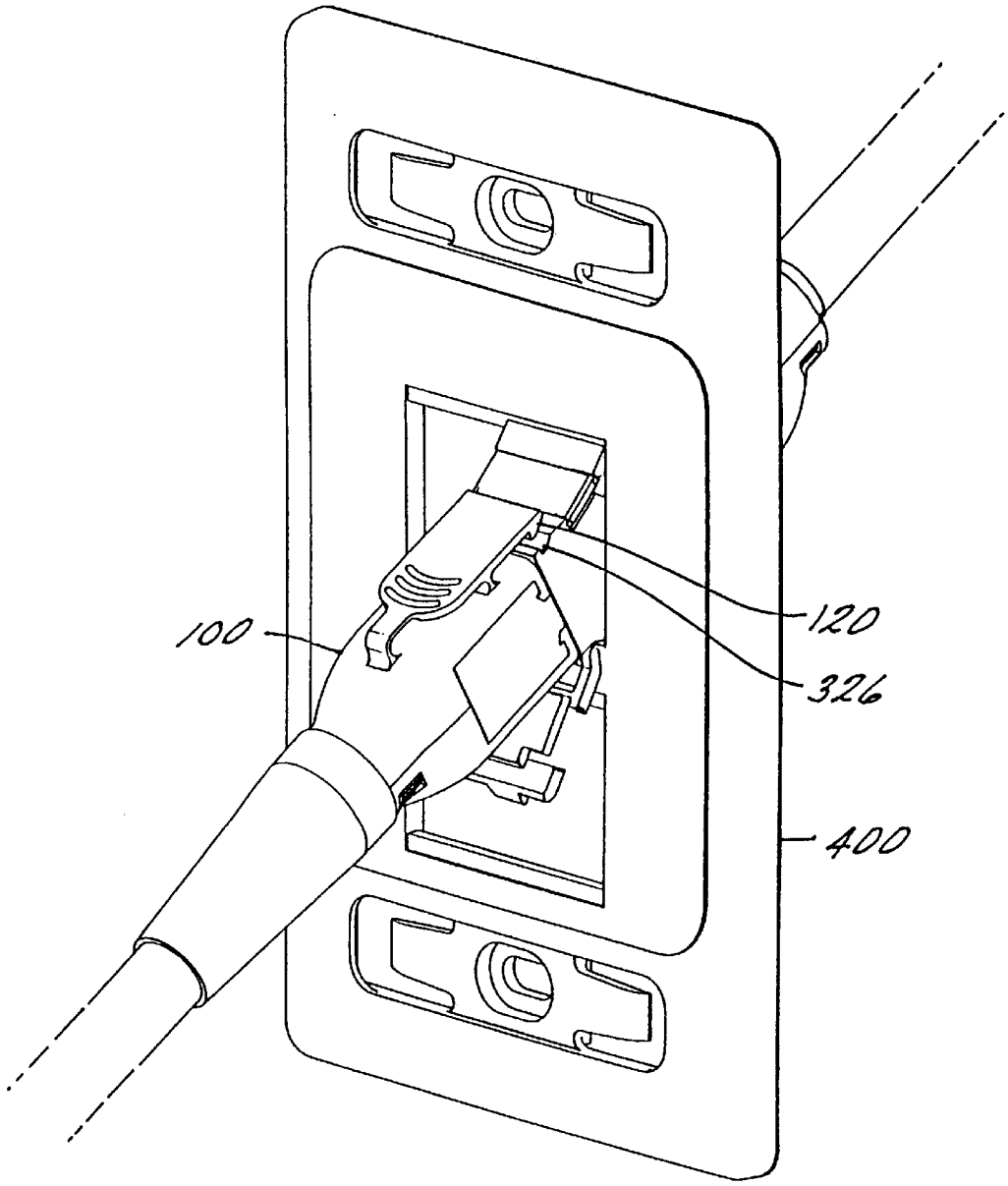
FIG. 24 is a perspective view of the plug mated with the outlet mounted in the faceplate.

FIG. 23 is a perspective view of the outlet 300 mounted in a faceplate 400. As shown in FIG. 23, the opening of the outlet 300 is at an angle relative to the faceplate. This angle is established by notch 314 on the outlet top cover 302 and notch 315 on the outlet core 306 lying in a plane at an oblique angle relative to the face 317 of the outlet. As noted previously, this creates a gravity feed orientation in which the cable connected to a plug mated with outlet 300 is angled towards the floor thereby reducing the bend on the cable. This reduces the likelihood that the cable will be bent below the minimum bend radius. The identification icon 324 also serves as a lock securing the outlet 300 in the faceplate 400. To install the outlet 300 in the faceplate 400, the resilient arms 312 are deflected until both notch 314 and notch 315 are aligned with the edge of the faceplate opening. At this point, arms 312 return to their original position. When the identification icon 324 is positioned in recess 318 and recess 322, this prevents the arms 312 from deflecting towards outlet core 306 and thus locks the outlet 300 in position in the faceplate 400. FIG. 24 is a perspective view of the plug 100 mated with the outlet 300. Lip 120 engages recess 326 to secure plug 100 to outlet 300. In an alternative embodiment, the outlet 300 can also be mounted in a flat configuration in which the face of the outlet is parallel to the faceplate 400 as described above.

Figure 25:
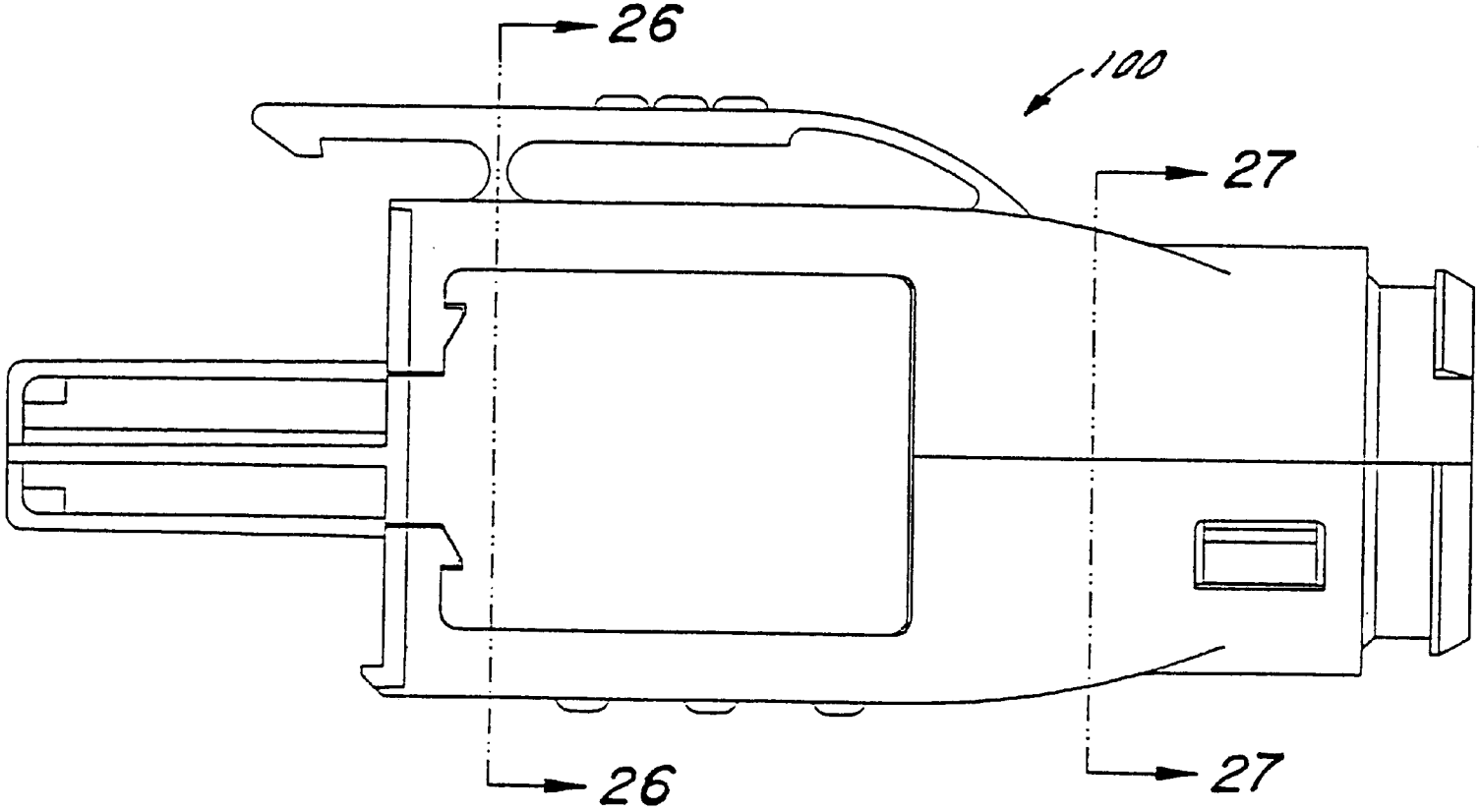
FIG. 25 is a side view of the plug.
Figure 27:
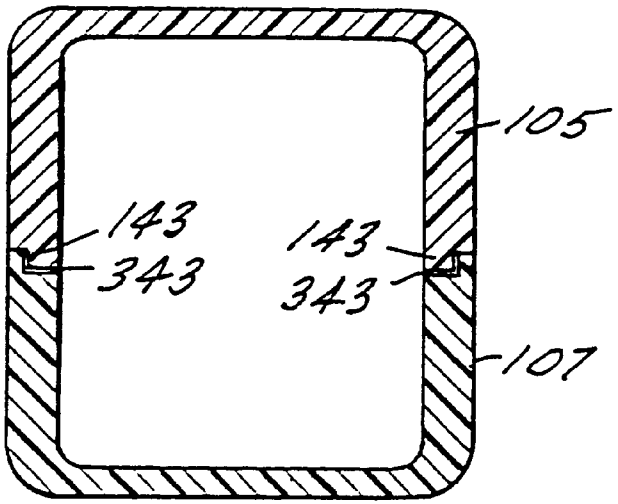
FIG. 27 is a cross sectional view taken along line 27—27 of FIG. 25.
Figure 26:
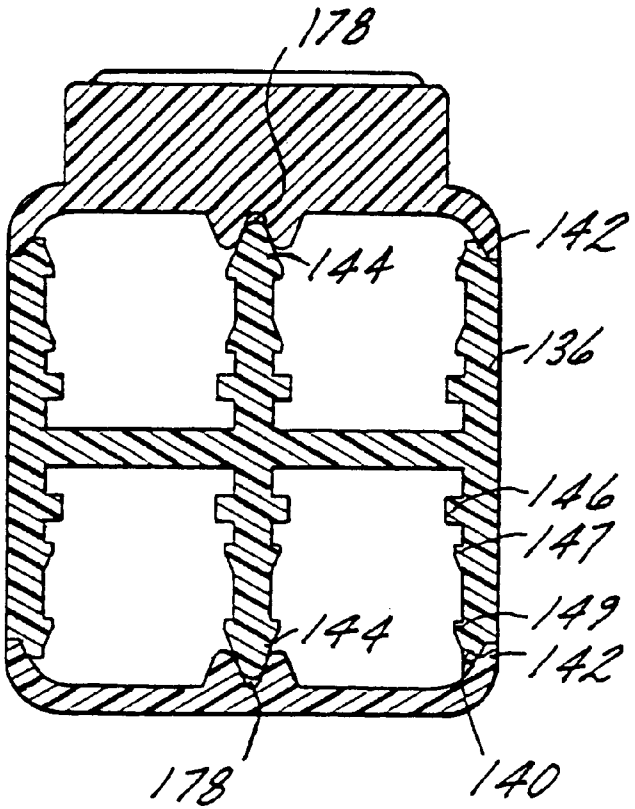
FIG. 26 is a cross sectional view taken along line 26—26 of FIG. 25.

The present invention provides an enhanced telecommunications plug and outlet in which each pair of contacts is individually shielded. No two separate shield members are joined at a butt joint, but rather all significant junctions between separate (non-integral) shield members include some form of overlap. FIGS. 25–32 illustrate the overlapping shield joints. FIG. 25 is a side view of plug 100. FIG. 26 is a cross-sectional view taken along line 26—26 of FIG. 25 and shows the overlap between various plug shield members. FIG. 27 is a cross sectional view taken along line 27—27 of FIG. 25. Outlet 300 is similar to plug 100 in that top cover 302 and bottom cover 304 includes channels 178 for receiving ridges 337 on second planar shield 336. The top cover 302 and bottom cover 304 include recesses 303 for receiving extensions 327 on outlet core side walls 326. Extensions 309 on outlet top cover 302 are received in recesses 313 in outlet bottom cover 304.

Figure 28:
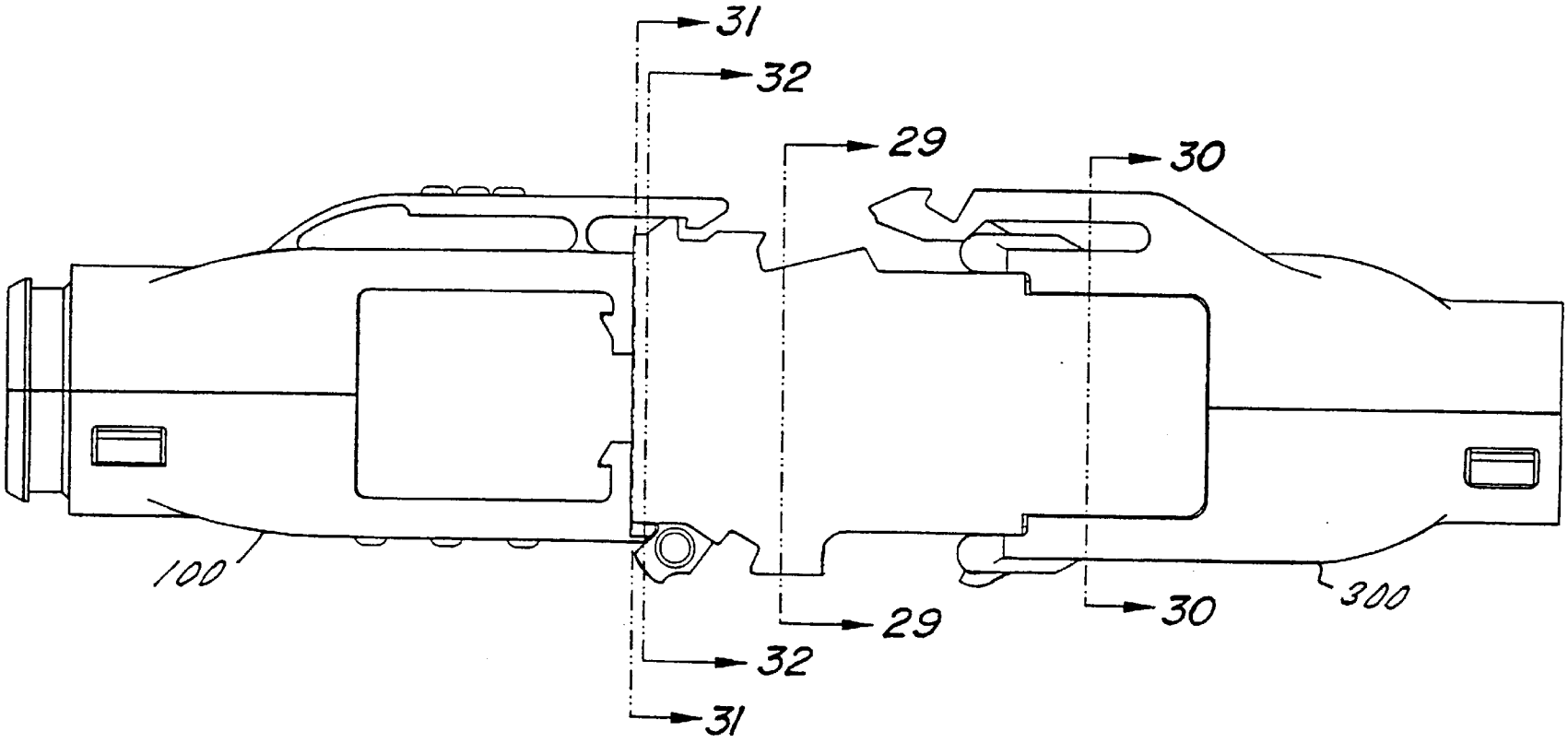
FIG. 28 is a side view of the plug and outlet mated.
Figure 30:
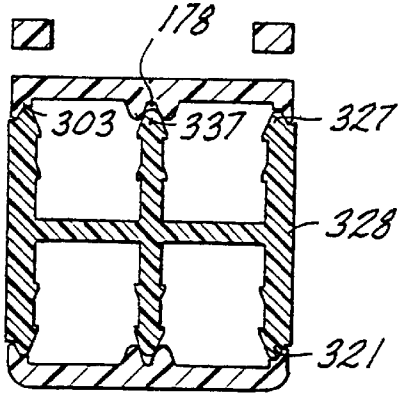
FIG. 30 is a cross sectional view taken along line 30—30 of FIG. 28.
Figure 32:
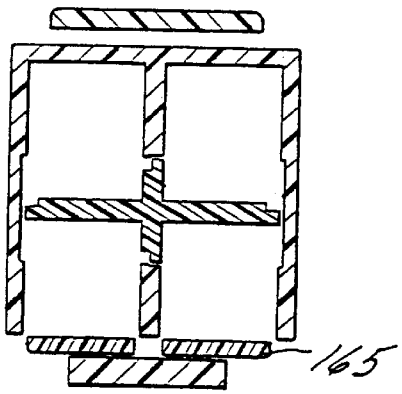
FIG. 32 is a cross sectional view taken along line 32—32 of FIG. 28.
Figure 29:
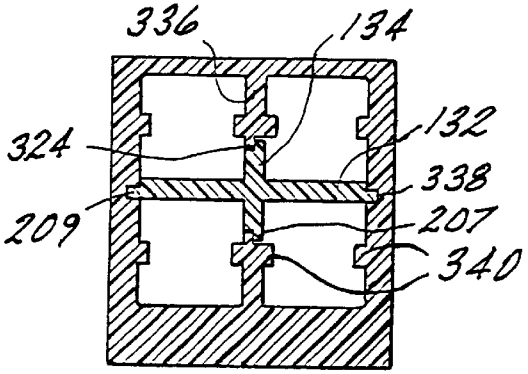
FIG. 29 is a cross sectional view taken along line 29—29 of FIG. 28.
Figure 31:
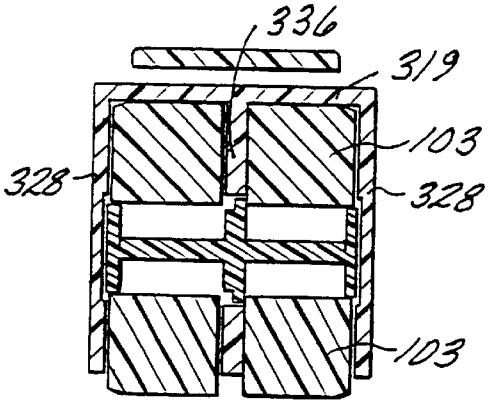
FIG. 31 is a cross sectional view taken along line 31—31 of FIG. 28.

FIG. 28 is a side view of the plug 100 mated to the outlet 300 and FIGS. 29–32 are cross-sectional views taken along FIG. 28. FIG. 29 illustrates the overlap between shield members in the outlet core and plug core. As shown in FIG. 29, second planar shield member includes an offset rib 207 along its edge that overlaps shield extension 342. The offset rib 207 also provides a keying function so that the plug can only be installed in outlet 300 in one orientation. Similarly, first planar shield 132 includes an offset rib 209 on its edge for engaging channel 338 which also provides keying. FIG. 30 illustrates the overlap between the outlet core, the outlet top cover and the outlet bottom cover. FIG. 31 is a cross sectional view of the junction between the plug and the outlet showing how the outlet top wall 319 and outlet side walls 328 overlap the front face 103 of the plug 100. FIG. 32 is a cross-sectional view taken along line 32—32 of FIG. 28 showing the bottom cover lip 165 which extends under outlet core bottom wall 332. Accordingly, each contact carrier is enclosed in a quadrant where all shield joints have some overlap and the amount of shielding between pairs is enhanced as compared to a shield arrangement using butt joints.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A shielded telecommunications connector comprising:

a conductive core having parallel core side walls, a horizontal shield joined to and perpendicular to said side walls, a vertical shield joined to and perpendicular to said horizontal shield, said vertical shield being positioned between said side walls;

at least one contact carrier containing a contact, said contact having an insulation displacement contact for making electrical connection with a wire, said contact carrier being positioned on said horizontal shield between said vertical shield and one of said side walls; and, at least one termination cap for receiving the wire and said insulation displacement contact, said termination cap positioning the wire relative to the insulation displacement contact;

one of said sidewalls having a sidewall ledge facing said vertical shield, said vertical shield having a vertical shield ledge facing said one of said sidewalls;

said termination cap including a first lip positioned beneath said sidewall ledge and a further first lip positioned beneath said vertical shield ledge to retain said termination cap to said conductive core;

wherein said horizontal shield extends beyond a length of the termination cap.

2. The telecommunications connector of claim 1 wherein:

said side walls extend beyond the length of the termination cap.

3. The telecommunications connector of claim 1 wherein:

said vertical shield extends beyond the length of the termination cap.

4. The shielded telecommunications connector of claim 1 wherein:

said contact carrier has a forward end and a rearward end;

said insulation displacement contact being positioned between said forward end and said rearward end; and said horizontal shield extends along an entire length of said contact carrier.

5. The shielded telecommunications connector of claim 1 wherein:

said contact carrier includes a lip for engaging said conductive core and positioning said contact carrier relative to said conductive core.

6. The shielded telecommunications connector of claim 5 wherein:

said lip is perpendicular to a base of said contact carrier, said lip engaging an edge of said horizontal shield.

7. The shielded telecommunications connector of claim 1 wherein:

said contact carrier has a forward end and a rearward end;

said insulation displacement contact being positioned between said forward end and said rearward end; and said vertical shield extends along an entire length of said contact carrier.

8. The shielded telecommunications connector of claim 1 wherein:

said termination cap includes a second lip positioned above said sidewall ledge and a further second lip positioned above said vertical shield ledge.

* * * * *

UNITED STATES PATENT AND TRADEMARK OFFICE

CERTIFICATE OF CORRECTION

PATENT NO. : 6,328,601 B1
DATED : December 11, 2001
INVENTOR(S) : Yip et al.

It is certified that error appears in the above-identified patent and that said Letters Patent is hereby corrected as shown below:

Title page,
Item [57], ABSTRACT,
Line 3, after “Contacts." delete “shield" and insert therefore -- There are shield --
Line 5, after "members" insert therefor -- are --

Column 1,
Line 67, after "contacts." delete "shield" and insert therefor -- There are shield --

Column 2,
Line 2, after "members" insert -- are --

Column 4,
Line 52, after "having" delete -- a --

Column 5,
Line 43, after "first" (first occurrence) delete "positioned" and insert therefor -- position --
Line 54, after "boot" delete "122" and insert therefor -- 112 --

Column 7,
Line 15, after "arms" delete "314" and insert therefor -- 312 --
Line 58, after "shield" (first occurrence) delete "336" and insert therefor -- 334 --
Line 58, after "shield" (second occurrence) delete "338" and insert therefor -- 336 --
Lines 62 and 63, after "shield" delete "338" and insert therefor -- 334 --
Line 63, after "shield" delete "338" and insert therefor -- 336 --

Column 8,
Line 46, after "and" delete "a”

UNITED STATES PATENT AND TRADEMARK OFFICE

CERTIFICATE OF CORRECTION

PATENT NO. : 6,328,601 B1
DATED : December 11, 2001
INVENTOR(S) : Yip et al.

It is certified that error appears in the above-identified patent and that said Letters Patent is hereby corrected as shown below:

Column 10,
Line 2, after "walls" delete "326" and insert therefor -- 328 --

Signed and Sealed this

Twenty-eighth Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,328,601 B1
DATED : December 11, 2001
INVENTOR(S) : Yip et al.

It is certified that error appears in the above-identified patent and that said Letters Patent is hereby corrected as shown below:

Title page,
Item [57], ABSTRACT,
Line 3, after "Contacts." delete "shield" and insert therefore -- There are shield --.
Line 5, after "members" insert therefor -- are --.

Column 1,
Line 67, after "contacts." delete "shield" and insert therefor -- There are shield --.

Column 2,
Line 2, after "members" insert -- are --.

Column 4,
Line 52, after "having" delete -- a --.

Column 5,
Line 43, after "first" (first occurrence) delete "positioned" and insert therefor -- position --.
Line 54, after "boot" delete "122" and insert therefor -- 112 --.

Column 7,
Line 15, after "arms" delete "314" and insert therefor -- 312 --.
Line 58, after "shield" (first occurrence) delete "336" and insert therefor -- 334 --.
Line 58, after "shield" (second occurrence) delete "338" and insert therefor -- 336 --.
Line 62, after "shield" delete "336" and insert therefor -- 334 --.
Line 63, after "shield" delete "338" and insert therefor -- 336 --.

Column 8,
Line 46, after "and" delete "a".

UNITED STATES PATENT AND TRADEMARK OFFICE

CERTIFICATE OF CORRECTION

PATENT NO. : 6,328,601 B1
DATED : December 11, 2001
INVENTOR(S) : Yip et al.

It is certified that error appears in the above-identified patent and that said Letters Patent is hereby corrected as shown below:

Column 10,
Line 2, after "walls" delete "326" and insert therefor -- 328 --.

This certificate supersedes Certificate of Correction issued June 28, 2005.

Signed and Sealed this

Sixth Day of September, 2005

JON W. DUDAS
*Director of the United States Patent and Trademark Office*